US005097652A

United States Patent [19]

Inamura et al.

[11] Patent Number: 5,097,652

[45] Date of Patent: Mar. 24, 1992

[54] DRUG PACKING APPARATUS

[75] Inventors: Atuo Inamura; Hiroyasu Shimizu; Manabu Haraguchi; Hitoshi Ishiwatari, all of Gunma, Japan

[73] Assignee: Sanyo Electric Co., Ltd., Osaka, Japan

[21] Appl. No.: 562,740

[22] Filed: Aug. 6, 1990

[30] Foreign Application Priority Data

Aug. 10, 1989 [JP] Japan ..... 1-208125
Aug. 21, 1989 [JP] Japan ..... 1-214383

[51] Int. Cl.[5] ..... B65B 35/54; B65B 57/14

[52] U.S. Cl. ..... 53/493; 53/154; 53/168; 53/551; 53/238; 53/247

[58] Field of Search ..... 53/493, 154, 237, 238, 53/168, 247, 551; 221/129, 197, 287, 298

[56] References Cited

U.S. PATENT DOCUMENTS 2,361,052 10/1944 Patterson ..... 53/551 X
2,730,283 1/1956 Sieurin ..... 53/23 X
2,865,156 12/1958 Wolfson ..... 53/237
3,028,713 4/1962 Kennedy ..... 53/247 X
3,474,932 10/1969 Rogge ..... 221/298 X
3,545,164 12/1970 Middleton ..... 53/247 X
3,861,121 1/1975 Monsees ..... 53/551 X
4,655,026 4/1987 Wigoda ..... 53/238 X

FOREIGN PATENT DOCUMENTS 58-46962 10/1983 Japan .
61-153701 9/1986 Japan .
63-11253 3/1988 Japan .
19222 1/1990 Japan ..... 53/168

*Primary Examiner*—John Sipos
*Attorney, Agent, or Firm*—Darby & Darby

[57] ABSTRACT

The drug packing apparatus, provided with: a drug storing section in the upper portion of its casing; a packing machine in its lower portion, for making drug packs; a multiplicity of elongate tablet cases which extend upwardly and are in planar arrangement to one another; a transfer mechanism for collectively transferring into a pack a predetermined number of drugs extracted from a selected drug cases and sealing the pack; and a transport means for delivering the packs out of the drug packing apparatus.

11 Claims, 27 Drawing Sheets

DRUG PACKING APPARATUS

FIELD OF THE INVENTION

The invention pertains to a drug packing apparatus for use in hospitals and pharmacies, for automatically packing one or more kinds of drugs, which are typically medicine tablets as prescribed for each patient.

BACKGROUND OF THE INVENTION

Although the kinds of tablets ordinarily prescribed in hospitals and pharmacies are several thousands, most frequently used are limited to less than about 800. Therefore most hospitals conventionally uses a combination of several tablet packing apparatuses which can each deal with about 250 kinds of tablets. Such apparatuses may be controlled by a personal computer, say, and may automatically deliver prescribed tablets packed. Prior art tablet packing apparatuses, for example the one disclosed in Japanese Utility Model Publication No. Sho-58-46962, have an upper tablet-storage portion and a lower funnel type hopper portion, a shutter, and a packing machine in one casing. Said tablet storing portion contains a multiplicity of vertical parallelpiped tablet cases stacked at several levels, from which required (kinds and number of) tablets are extracted or discharged upon an extraction signal given to the control unit of the apparatus. The tablets are introduced into a lead passage through the hopper and transferred to a packing machine through the shutter. The packing machine comprises a roll of two-fold packing sheet which may be easily thermally sealed, tension rollers, a longitudinal heat seal mechanism for making a small pack for the tablets by thermally sealing the sheets at lower and upper ends thereof, a transverse heat seal roller for sealing the upper opening of the pack after the pack is charged with the tablets, and a sheet feeding roller. The sheet feeding roller is driven intermittently to transfer the sheets. When the roller is temporarily stopped the longitudinal heat seal mechanism makes a small pack into which the tablets are discharged from the open shutter and the transverse heat seal mechanism seals the pack completely.

However, such a tablet storing portion as mentioned above has multi-layered stacks of tablet cases extending upwardly, the height of the tablet packing apparatus extends too high. As a consequence, a person of small height has great difficulty in replenishing the tablets. Furthermore, on account of the improper height, those tablets in high tablet cases are subject to strong impact and often get crushed as they fall into the hopper through the lead passage. Still further, empty tablet cases cannot be removed from their positions for replenishment during the packing operation, since, if they are removed leaving an empty space, tablets falling from other tablet cases might pop out of the space.

BRIEF SUMMARY OF THE INVENTION

The invention is directed to overcome these disadvantages. Therefore, the primary object of the invention is to provide a tablet packing apparatus having a limited height, which is convenient for users and advantageous in preventing damage due to the falling impact, thereby maintaining the quality of the medicines, and being capable of replenishing tablets even during packing operation.

In order to attain these objectives, the tablet packing apparatus of this invention comprises: a tablet storing section; a packing machine disposed below said tablet storing section for making drug packs; a multiplicity of elongate tablet cases which extend upwardly and are in planar arrangement to one another; a transfer mechanism for collectively transferring into a pack a predetermined number of tablets extracted from a selected tablet cases; and a control unit for controlling the extraction of the tablets from said tablet cases and the operation of the transfer mechanism.

The tablet packing apparatus thus constructed is compact in size and hence permits not only saving installation space, provide users easy access, but also replenishing tablets during packing operation.

The above mentioned transfer mechanism is favorably provided with a reciprocally movable container whose bottom may be closed at a first position where the container receives prescribed drugs and opened at a second position where the container collectively transfer the drug into a pack. It is also favorable to provide the drug packing apparatus with a pack opening mechanism which widely opens the pack as the container comes to said second position for transferring the drugs.

These mechanisms will allow elimination of a shutter and permits uniform packing of the prescribed medicine in one pack. It is then easy to prevent buckling of the packs during transport of the packed sheet, and to provide the packs neatly folded. Opening and closing operation of the pack opening mechanism may be carried out in cooperation with the movable container by means of a simple link mechanism, without any independent driving unit.

It is preferable to provide the tablet packing apparatus with a drug pack transport means for delivering the packs to the outlet of the apparatus. Such transport means comprises a L-shaped frame, at least two pairs of rollers mounted on the opposite ends of the frame, a driving pulley mounted at one corner of the frame, two flat belts each trained over the rollers, forming double layered conveyers extending between the upper and lower end of the frame, and a tension means for displacing the shafts of the rollers in the direction away from the belts. The drug pack transport means is adapted to convey a series of packs carried in between the flat belts from the lower end of the frame to the outlet at the upper end of the frame.

The drug pack transport means is useful in providing the packs at a reasonable height, which is also good from the point of convenience and hygiene. The tension means provides proper tension of the flat belts and reliable transfer of the packs irrespective of the amount of the tablets packed therein. A cutter may be provided subsequent to the packing machine so as to prevent empty packs from being transferred.

The tablet cases above each have a form of elongate pipe having a storage section in the upper portion thereof and a mechanical section in the lower portion. The mechanical section comprises a cylinder which has a hole through the longitudinal central axis thereof and are bisected into two semi-cylinders along the axis, a driving shaft for supporting and alternately driving the semi-cylinders up and down, a multiplicity of pawls which come in and out of said holes in association with the upward and downward motion of the semi-cylinders. By the operation of the pawls the tablets may be lined-up in the storage section, and separated as they are discharged from the lower end of the tablet storing case. With the help of a detection arm, the pawl permits accurate detection and discharging of the individual tablets.

The tablet cases are favorably provided over their upper opening with a freely movable lid whose back side serves as a guide for the drug to be replenished.

This arrangement will allow rellable and convenient replenishing of tablets to the tablet cases which are disposed in planer arrangement, without the use of funnels and the like or dismounting the cases from the packing apparatus. This is a great advantage of the invention over conventional ones.

In addition to the multiplicity of elongate tablet cases in planer arrangement the tablet packing apparatus of the invention may further comprise a casing that encases in its upper portion a tablet storing section and in its lower portion the packing machine; a hopper installed below the tablet cases and having at its bottom a linear outlet where two of the opposite inclined panels of the hopper meet; and a multiplicity of inclined guide plates beneath the hopper for guiding the tablets falling from the hopper towards the center of the guide plates; a pair of conveyers for collecting the tablets falling onto them towards the center of the conveyers, said center being vertically aligned with the center of the hopper; and a control unit for controlling the extraction of the tablets from the cases; transfer of the tablets into the pack, and the transport of the packs.

At least one of the inclined panel is removable from the casing.

In this manner the packing apparatus may be compactly constructed with a limited height, and therefore convenient for the users and advantageous in saving installation space. Also, the tablets are prevented from the damage arising from falling impact. Further, replenishing drugs is possible without stopping the packing operation. Since the hopper plates are removable, cleaning of the hopper is easy for good sanitation, giving improved reliability in pharmacy.

The drug packing apparatus of the invention may be further improved by providing a prescription data input unit having a keyboard and a display for inputting data so as to control such operations as extraction of the tablets from the tablet cases, collecting tablets on the conveyers, and transfer by the transfer mechanism.

It is desirable to set up, in the control unit, period of time for the conveyers to operate (hereinafter referred to as operation time of the conveyers) in association with the position of each tablet case. The period of time may be predetermined on the basis of the distance between the position of a tablet case and the center of the hopper. In case where different kinds of tablets are specified in the prescription the time may be chosen for the tablet case which is most distant from the center of the hopper. By setting up the conveyer reference time in this manner, the user may simply specify the tablets in the prescription data, which automatically sets up time for conveyers to stay inactive and provides continuous and speedy transport of various kinds of tablets to a predetermined position in a single operation, thereby improving the operability of the drug packing apparatus.

BRIEF DESCRIPTION OF THE DRAWINGS

The accompanying drawings illustrate some examples embodying the invention. In particular.

DETAILED DESCRIPTION OF THE PREFERRED EMBODIMENT

Figure 1:
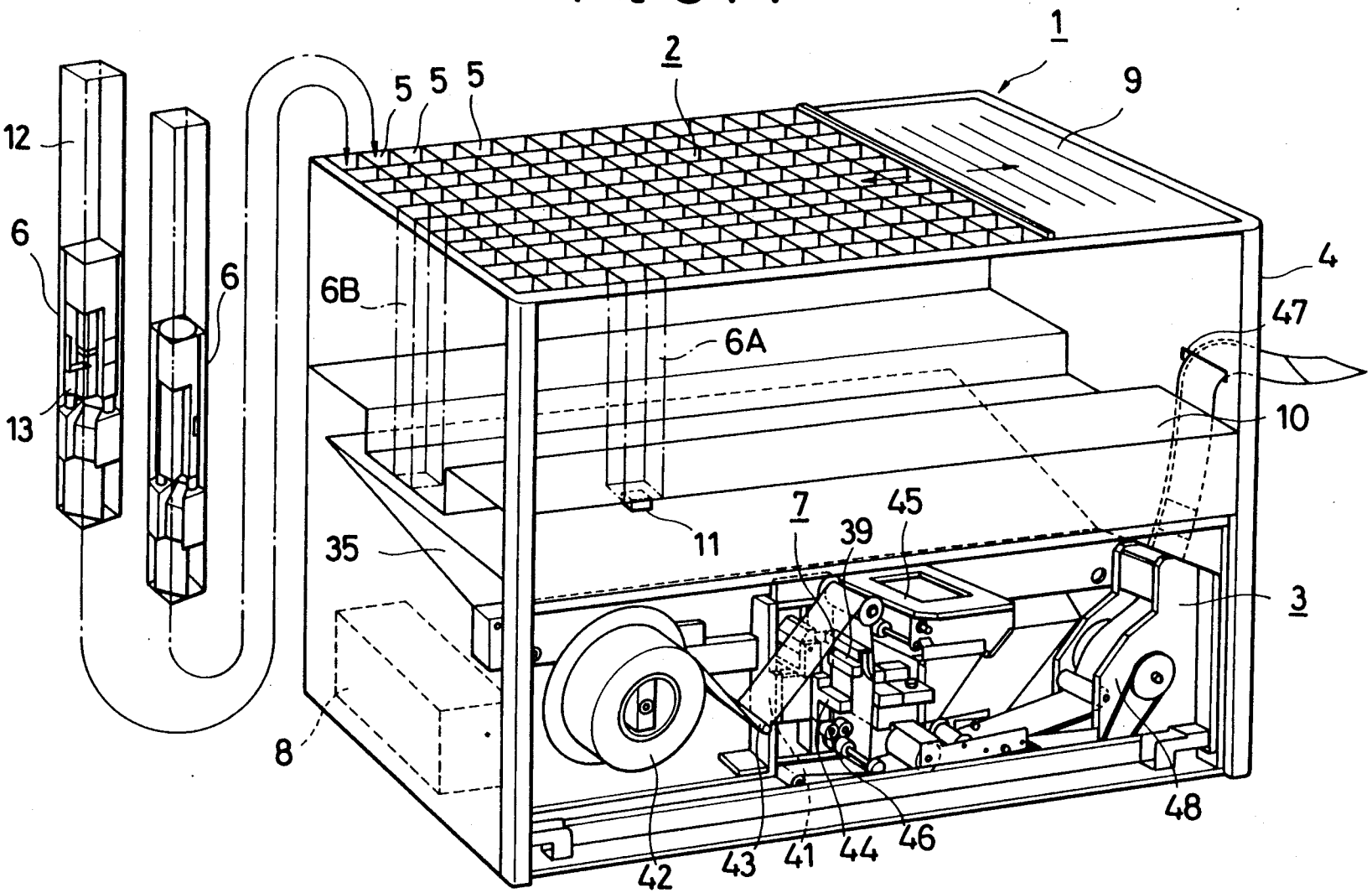
FIG. 1 is a perspective view showing inner construction of the packing apparatus and arrangement of the tablet cases.

As shown in FIG. 1, a drug packing apparatus 1 according to the invention comprises: a casing 4 for encasing in its upper portion a drug storing section 2 and in its lower portion a packing machine 3; a multiplicity of vertically elongate tablet cases 6 which are disposed in a planer arrangement to one another and individually inserted in a grid of partitions 5 of the drug storing section 2; a transfer mechanism 7 for transferring the tablets extracted from the selected tablet cases into a pack; and a control unit 8 for controlling the extraction of the tablets from the tablet cases 6 and the operation of the transfer mechanism 7. The apparatus is capable of sealing the pack with the tablets therein.

Figure 2:
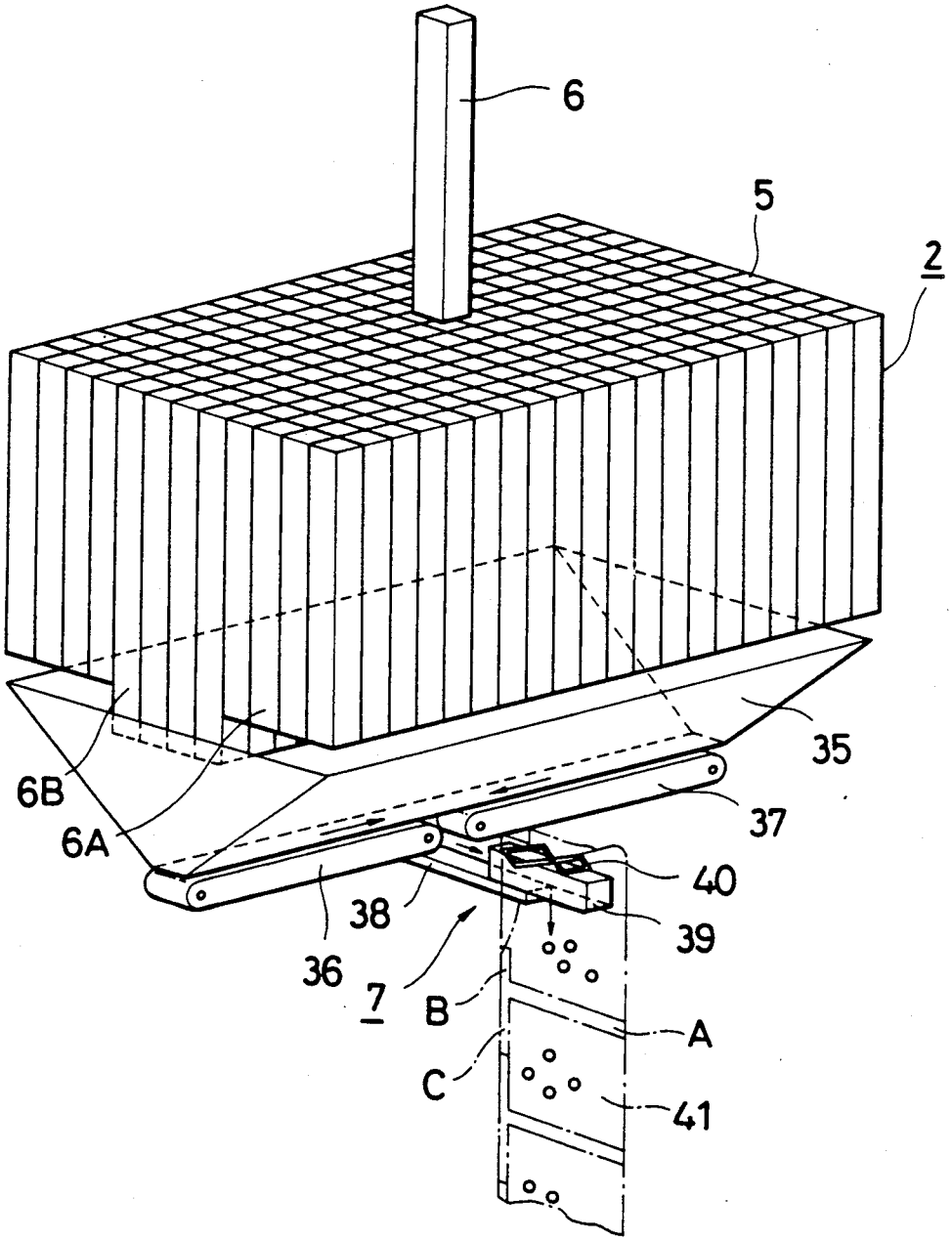
FIG. 2 is a perspective view of the drug storing section and a transfer mechanism.
Figure 3:
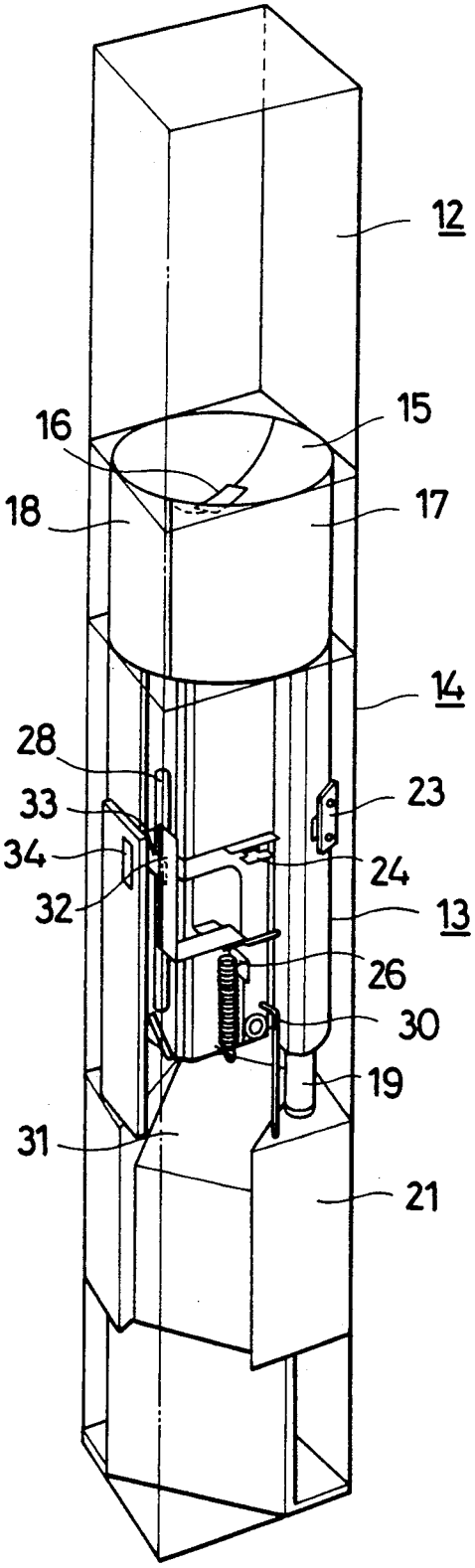
FIGS. 3 and 4 are perspective views of a tablet case.

As shown in FIGS. 1 and 2, the packing machine 3 comprises; a roll of two-fold packing sheet 41 rolled on the roller 42, the sheet being sealed by heat (In FIG. 2 the sheet is folded at its right edge and unsealed left edge will be sealed later in a heat seal mechanism 44); a tension roller 43; a printer 45 for printing on the packing sheet necessary data such as dose time; a T-shaped heat seal mechanism 44 for transforming the sheet into a series of packs (which will be referred to as drug packs) by sealing the sheet in T-shape in succession; a transport roller 46 for intermittently delivering the drug packs; and a drug pack transport means 48 for delivering a series of drug packs to the outlet 47.

The transport roller 46 drives intermittently the packing sheet 41. During each temporary halt of the packing sheet, the sheet is sealed by the heat-seal mechanism 44 in T-shape along a lower end A and half of the vertical edges B and C of the present and subsequent packs, respectively. This leaves the upper edge of the pack open. The tablets transported by the conveyers 36 and 37 will be, as described further later on, dropped from the gap between the conveyers 36 and 37 into the movable container 39.

The casing 4, which is provided with a slidable door 9 to cover the top thereof, may be opened by sliding away the door to expose the top of the tablet cases 6 disposed in the grid of partitions 5. In this example there are 12 partitions in one column and there are 10 rows of such columns, forming a unitary module (It should be noted that the invention will not be limited by the numbers of the columns and the rows.). Therefore, 120 tablet cases 6 may be installed in each module for storing 120 kinds of tablets. And hence storage of 120, 240, 360, 480 etc kinds of tablets is possible by the use of such modules when multiply connected. At the bottom of the partition 5 is a multi-holed bottom plate 10 which has a step and a central elongate recess. When placed on the bottom plate, the tablet cases 6 abut against connectors 11 which electrically connect the tablet cases with the control unit 8 for receiving driving signals and detection signals. Since the bottom plate has stepped levels as shown in FIGS. 1 and 2, it may receive tablet cases 6A and 6B having different lengths, which are convenient to store tablets of different sizes.

Figure 4:
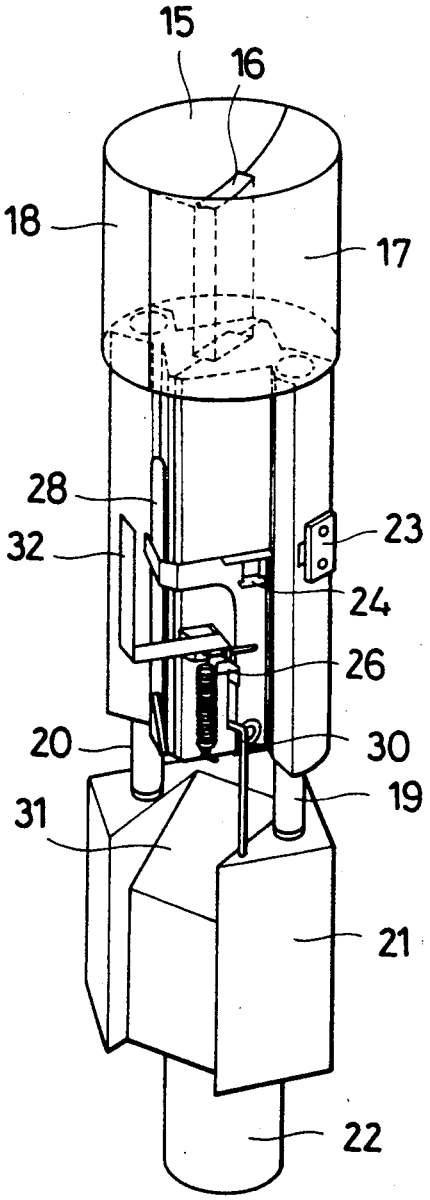
Figure 5:
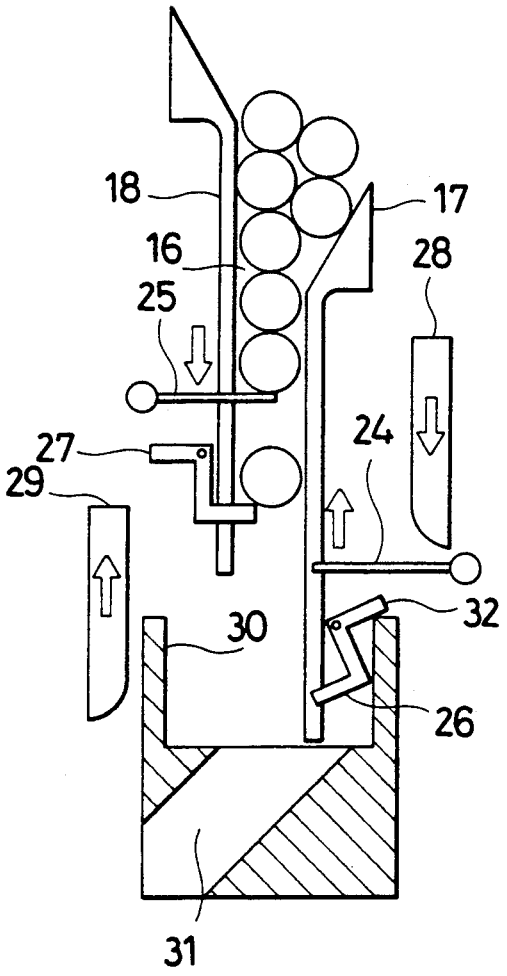
FIGS. 5 through 10 illustrate the operation of a tablet case in steps.
Figure 6:
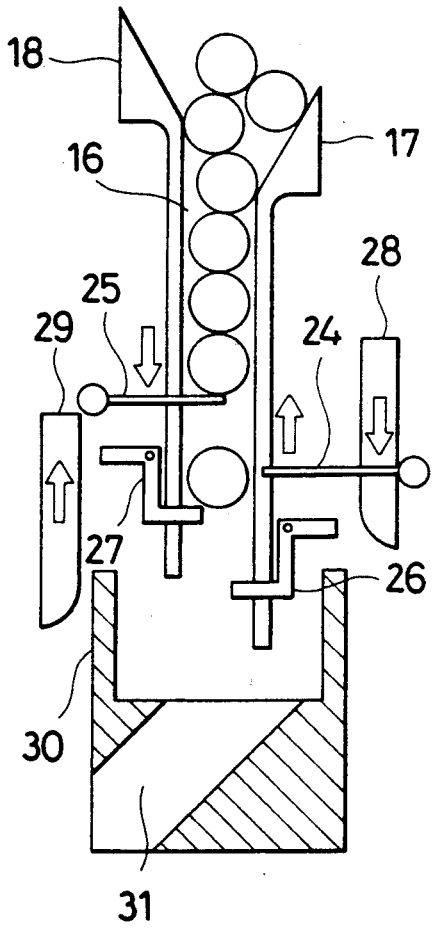
Figure 7:
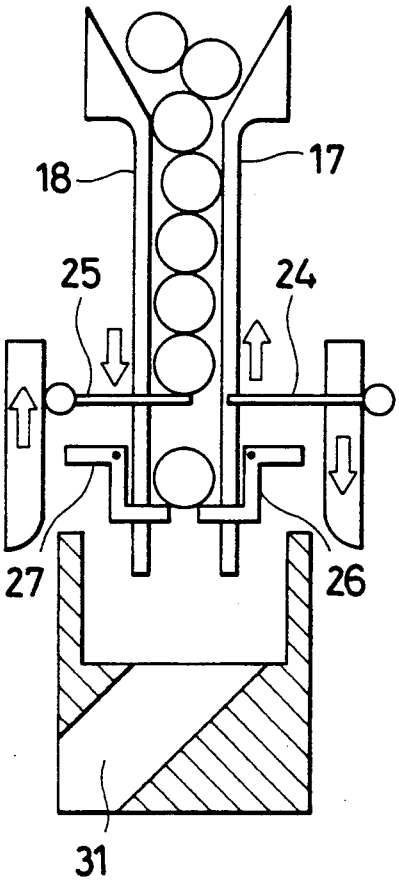
Figure 8:
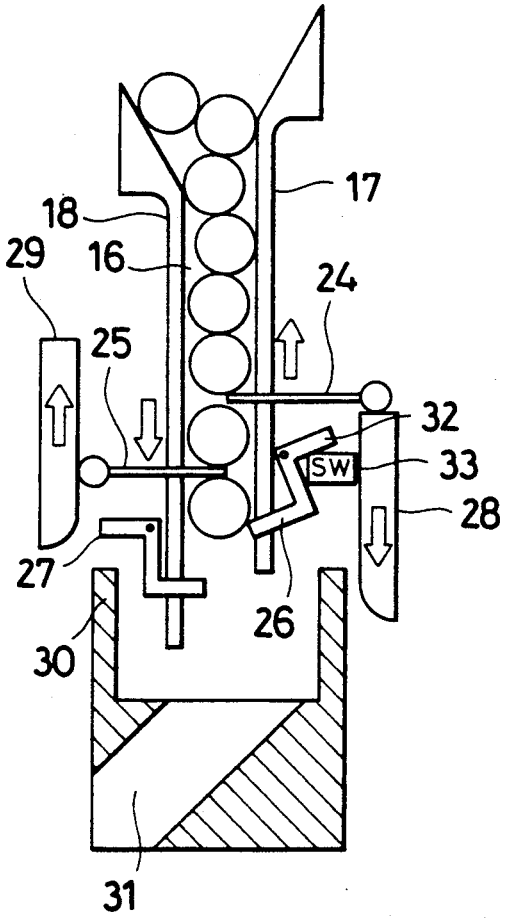

The tablet cases 6 as shown in FIG. 6 have external case configuration of elongate parallelpiped 14 (45 mm×300 mm for 6A, and 45 mm×400 mm for 6B), each comprising a tablet storing room 12 in the upper portion of the case and a mechanical section 13 in the lower portion. The mechanical section 13 has on its top a funnel shaped recess 15 as shown in FIG. 4, and a central hole 16 formed in the recess through the longitudinal axis of a cylinder which consists of two semi-cylinders 16 and 17. These semi-cylinders are supported by shafts 19 and 20, respectively, which are driven by a DC motor 22 via a reduction gears 21. The semi-cylinders may be alternately moved up and down by means of the relative motion between the threaded supporting shafts 19 and 20 and mating plates 23 mounted on, and movable with, the semi-cylinders. The semi-cylinders 17 and 18 are provided with pawls 24 and 25, respectively, and detection arms 26 and 27, respectively for separating the tablets falling in the hole 16. The semi-cylinders are also provided with projections 28 and 29, respectively, for changing the length of the pawls extending in the hole 16 with the ascending or descending motion of the semi-cylinders. As shown in FIG. 5 through FIG. 10, tablets may lined-up in the hole and the lowest one is separated from the rest and allowed to descend one by one by the action of the pawls 24 and 25 comming into and out of the hole as the they ascend or descend together with the semi-cylinders 17 and 18 and by means of the detection arms 26 and 27 extending into and retracting from the hole 16. As the tip of the descending detection arm 27 abuts on the projection 30 and the detection arms withdraw from the hole, tablets are discharged one at a time from the outlet 31. The projection 28 is formed on the semi-cylinder 18, so that they move together in the direction indicated by arrows in the Figures, while the projection 29 is formed on, and moves together with, the semi-cylinder 17. On one end of the detection arms 26 is mounted a shield plate 32, which crosses in between a lead switch 33 and a magnet 34. As the descending pawl 25 forces a tablet downward, the detection arm 26 is in turn pushed down as shown in FIG. 8, and the shield plate 32 shields the magnetic field of the magnet to turn on the lead switch 33, emitting a tablet extraction signal. When no tablet exists on the detection arm 26, the shield plate 32 is not set in motion, since the arm is not moved. Similarly, the detection arm 27 is provided with a shield plate at its end, which interacts with another set of lead switch and magnet. Since these switch and magnet play the same roles as the switch 33 and the magnet 34 for the detection arm 26, they are not shown in the Figure.

Extraction of tablets one by one from the tablet case 6 is carried out as follows.

Figure 9:
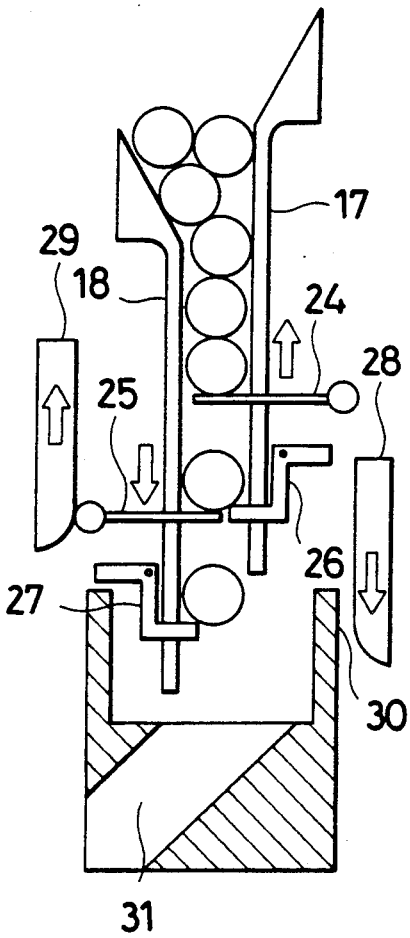
Figure 10:
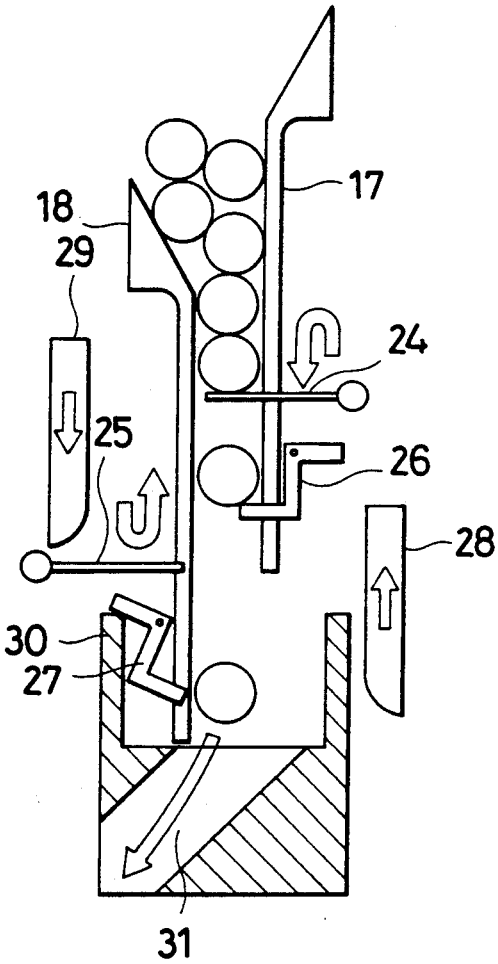

Firstly, as shown in FIG. 5, a single tablet is separated between a pawl 25 and the detection arm 27 by the ascending motion of the semi-cylinder 17 and descending motion of the detection arm 27. The tablet is then lowered as shown in FIG. 6 by the descending motion of the semi-cylinder 18, until the tablet is also supported by the ascending detection arm 26 as shown in FIG. 7. As the semi-cylinder 18 descends further, the tablet is supported only by the detection arm 26 until the pawl 25 pushes the tablet downward and makes the detection arm 26 to retract as shown in FIG. 8. As a consequence, the tablet falls onto, and is again supported by, the detection arm 27, and the arm 26 restores its projecting position as shown in FIG. 9. The arms 26 and the pawl 25 will support the next tablet as shown in FIG. 9. When the detection arm 26 retracts from the hole as shown in FIG. 8, the shield plate 32 of the arm 26 turns on the lead switch 33 to transmit a tablet extraction signal to the tablet packing machine 1. The ascending motion of the semi-cylinder 17 also causes the pawl 24 to move inside the projection 28 and extend into the hole 16 to separate the next tablet as shown in FIG. 8. As the semi-cylinder 18 is lowered, the shield plate of the detection arm 27 abuts on the projection 30, causing the arm 27 to retract from the hole 16, and discharging the tablet from the outlet 31. Next, as shown in FIG. 10, the other semi-cylinder 17, which has isolated the next tablet with its pawl 24 and the detection arm 26, begins to descend, repeating a similar operation as described above for the descending prism 18. In this way every alternate descending motion of the semi-cylinders 17 and 18 will separate, detect, and discharge one tablet.

Figure 11:
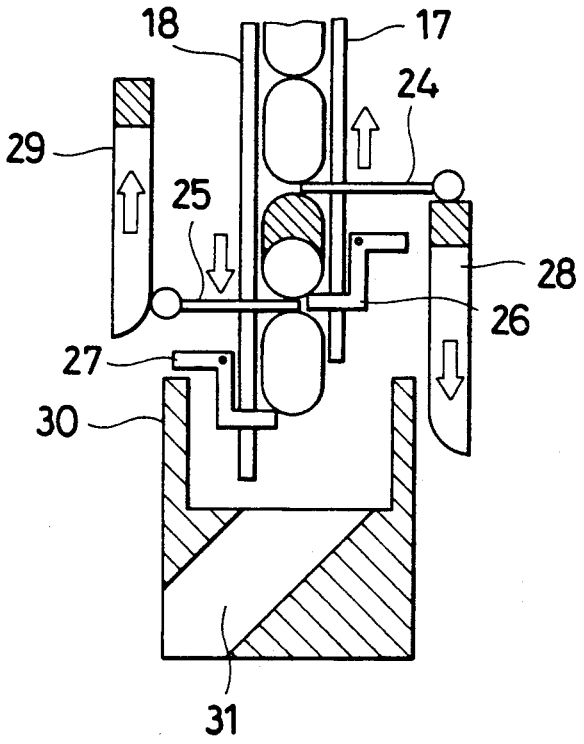
FIG. 11 illustrates a tablet case for use with large sized tablets.

For greater tablets (shaped in FIG. 11), projections 28 and 29 may be extended as shown in FIG. 11 by the length equal to the shaded portions so that the pawls 24 and 25 are given appropriate timing for greater tablets.

Figure 12:
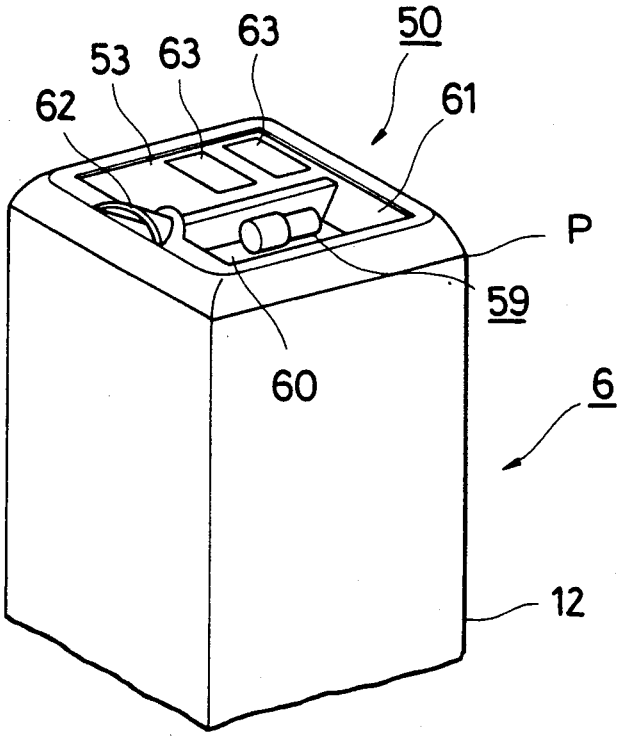
FIG. 12 is a perspective view of a tablet case with its lid closed.
Figure 13:
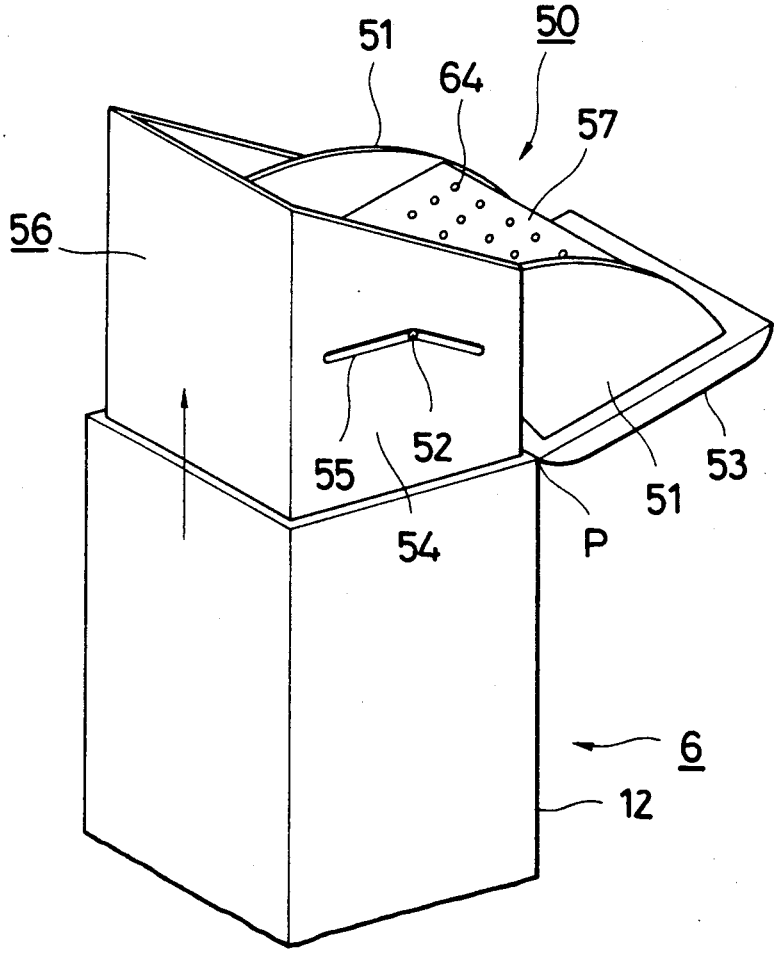
FIG. 13 is a perspective view of a tablet case with its lid opened.
Figure 15:
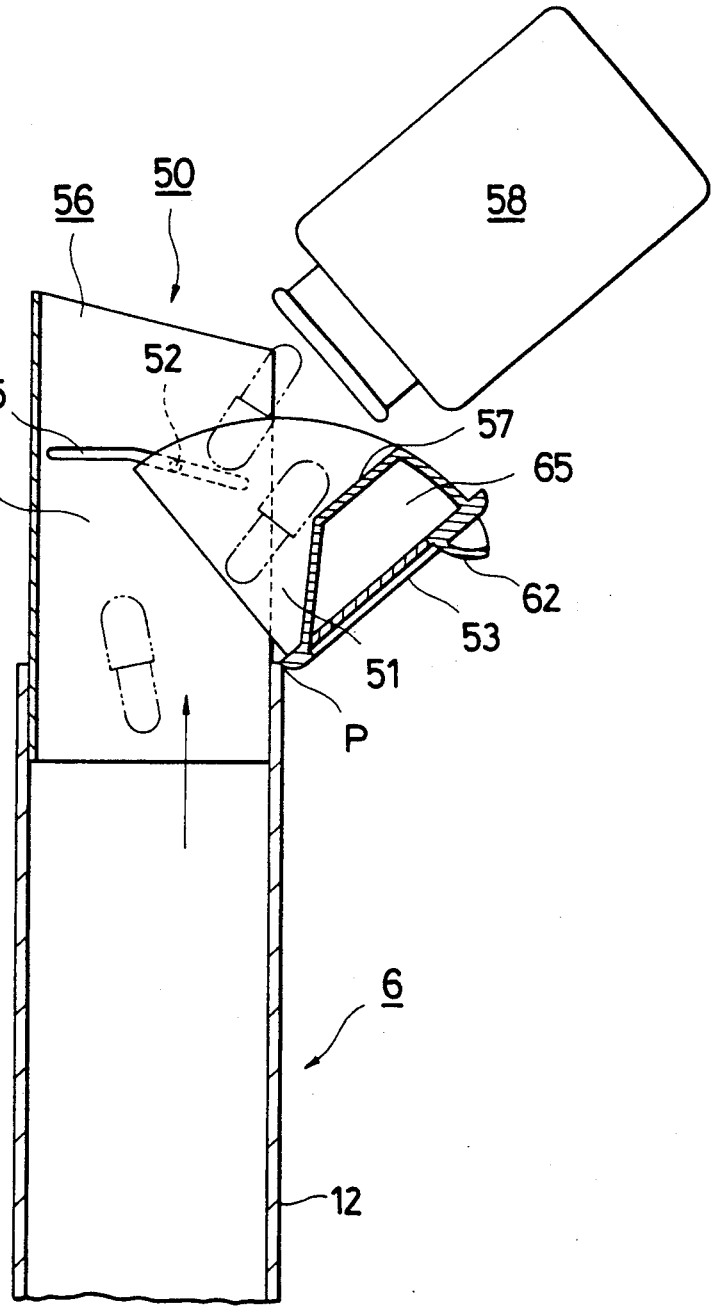
FIG. 15 is a side view of a tablet case with its lid opened, ready for receiving replenishing tablets.
Figure 14:
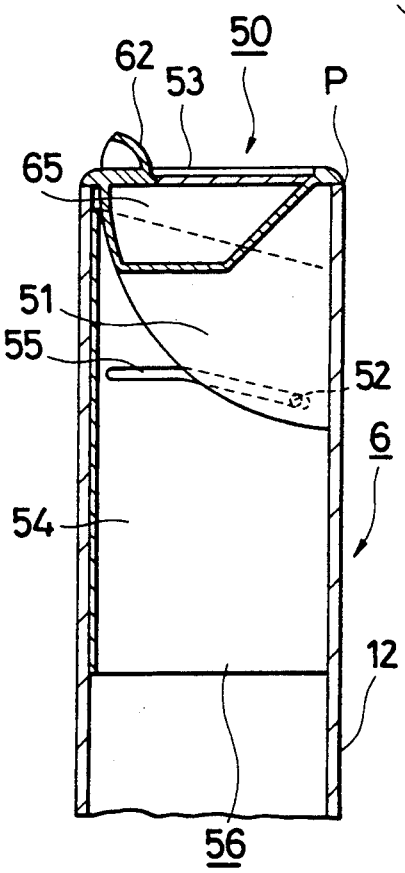
FIG. 14 is a side view of a tablet case with its lid closed.

FIGS. 12 through 15 shows the construction of a lid means 50 mounted on the top opening of the tablet storing room 12 of a tablet case 6. The lid means comprises an integral fan-shaped side plates 51, a guide pin 52, a lid 53 which is pivotally mounted at a fulcrum P at the upper end of the tablet storing room 12, a guide plate 56 having a cross section that may slidably fits in the tablet storing room 12. The guide plate 56 has guide grooves 55 which are formed on opposite sides 54 of the guide plate and engage with the associated guide pins 52. As the lid means 50 is opened by pulling out the handle 62 as described later, and as shown in FIGS. 14 and 15, the guide pins 52 make a circular motion about the fulcrum P, which accompanies lifting of the guide grooves 55, and hence the lifting of the guide plate 56. The back side 57 of the lid 53, opposite side plates 51, and the guide plate 56 together form a hopper having a large opening, as shown in FIG. 13. Namely, in replenishing tablets into a tablet case 6, one may simply swing open the lid 53 to form a big mouth or opening between the inclined lid 53 and the guide plate 56. The back side 57 of the lid serves as a guide for the tablets to slip smoothly into the tablet storing room 12, as shown in FIG. 15. Since the guide plate 56 elevates with the pivotal motion of the lid 53, forming the opening at an elevated position, one may bring a replenishing drug bottle 58 to the mouth without being bothered by other tablet cases, enabling him to accurately replenish drugs. For user's convenience, on the outer surface of the lid are a handle 62, an identification plates 63 for identifying (the number of) the case and the drug stored in storing room 12, and a sample room 59 (made up of a recess 62 and a transparent panel 61) as shown in FIG. 12. In order to protect the tablets from being damped, the lid 53 is provided with a deccicant container 65 having air passages 64 to protect the tablets from moisture.

Figure 16:
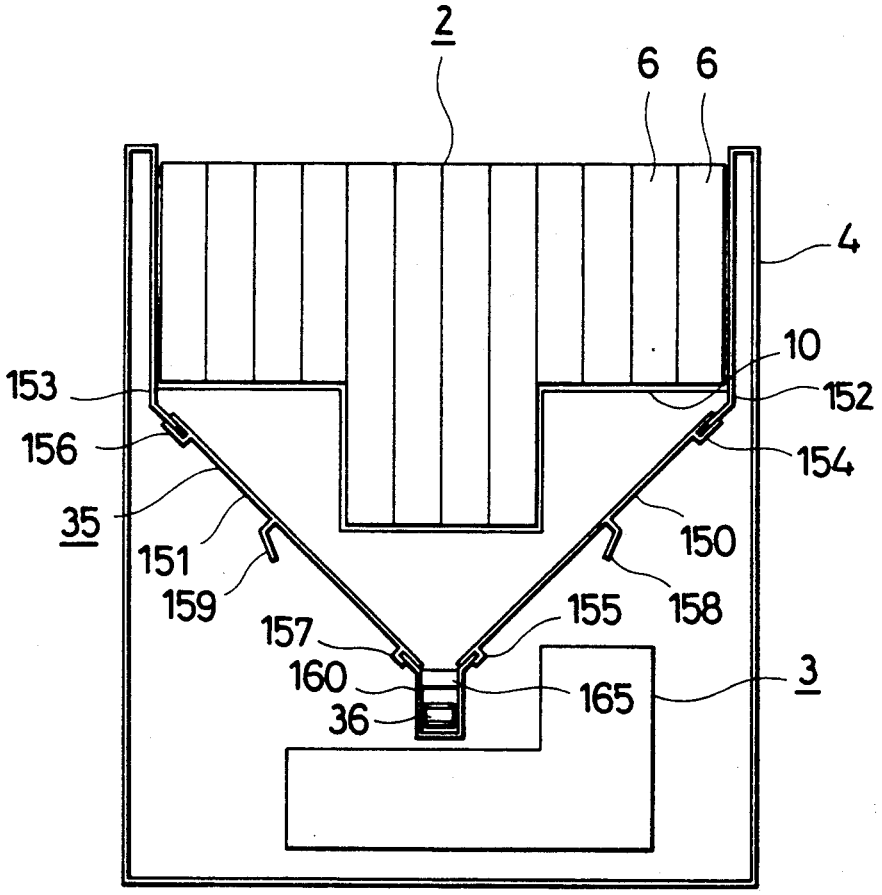
FIG. 16 is a cross section of a drug packing apparatus of the invention.
Figure 17:
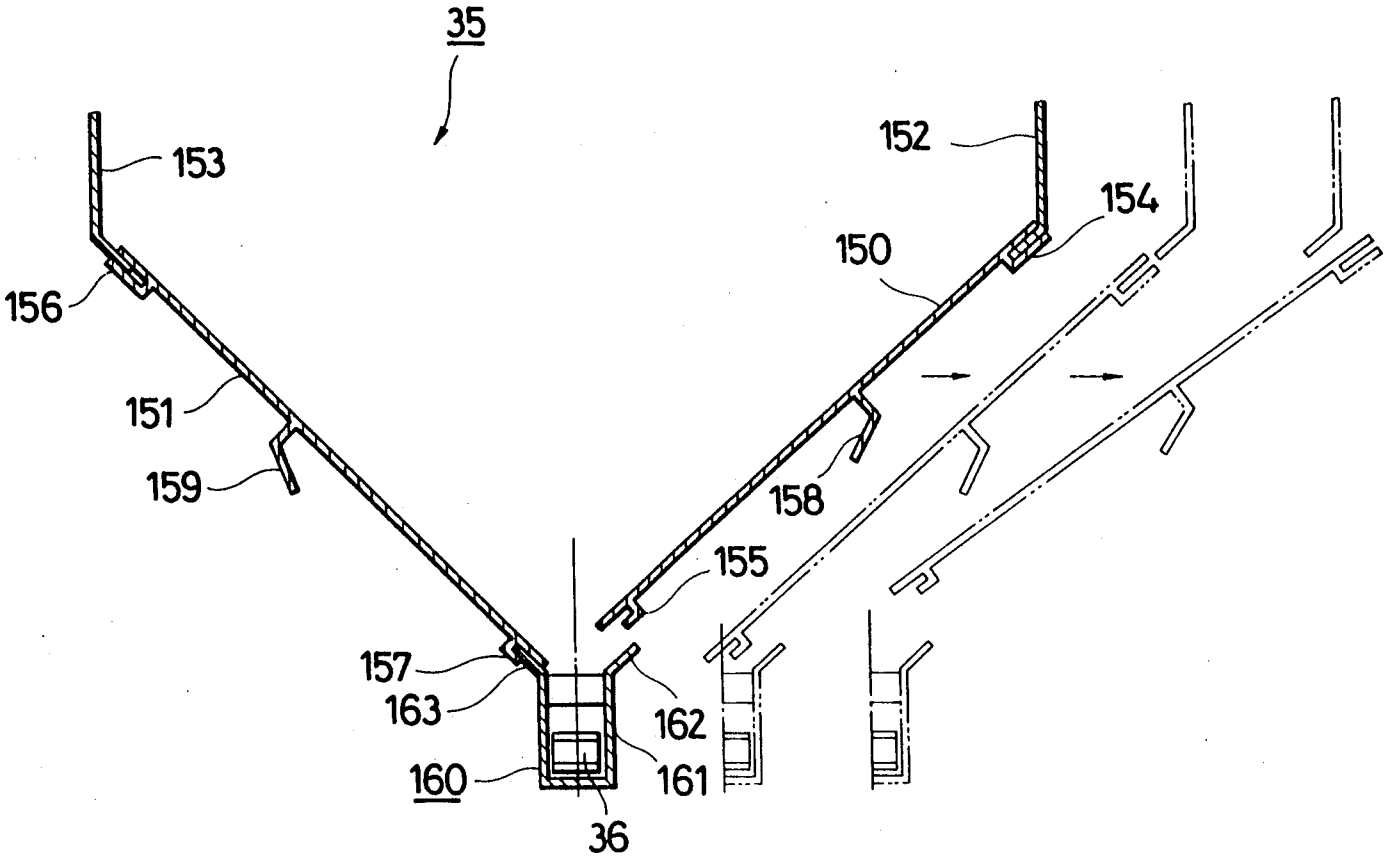
FIG. 17 is a schematic illustration of the procedures for removing one panel of the hopper.

The tablets discharged from the tablet case 6 is guided by the hopper 35 to the central region thereof, as shown in FIG. 2. The hopper 35 consists of opposing front and rear plates 150 and 151, respectively, inclined in the forward and rearward direction, respectively, as shown in FIGS. 16 and 17. The portions 152 and 153 of the casing 4 folded inside serve as the sides of the hopper. The hopper 35 thus has a triangular cross section with its apex pointing downward. The hopper 35, positioned below the tablet cases 6, functions to collect the tablets discharged from the outlet 31 of the tablet cases to the linear outlet of the hopper (which is perpendicular to the center line of the casing 4). The front and rear plates of the hopper 35 are provided at their upper and lower ends with ears 154 and 155, and 156 and 157, respectively, and, at the center of the outer surface, with handles 158 and 159. The hopper 35 is mounted on the casing 4 by engaging the ears 154 and 156 with tips of the folded portions 152 and 153, and by engaging the lower ears 155 and 157 with the projecting tips 162 and 163, respectively, of a guide means 160. The front and rear plates 150 and 151 may be dismounted by first lifting the handles 158 and 159 so as to disengage the lower ears 155 and 157 from the projecting tips 162 and 163 of the guide means 160, then pushing the lower ends towards inside the hopper, and finally disengaging the upper ears 150 and 151 from the folded portions 152 and 153. The plates may be mounted by following reverse steps mentioned above. In this manner, mounting and dismounting of the hopper may be done easily without using any special tools, since the hopper 35 is mounted on the casing 4 only with the ears 154, 155, 156, and 157, and accessible from the front end of the casing 4. When the rear plate 151 is to be dismounted, the rear end of the casing is opened (not shown in the figures).

Figure 18:
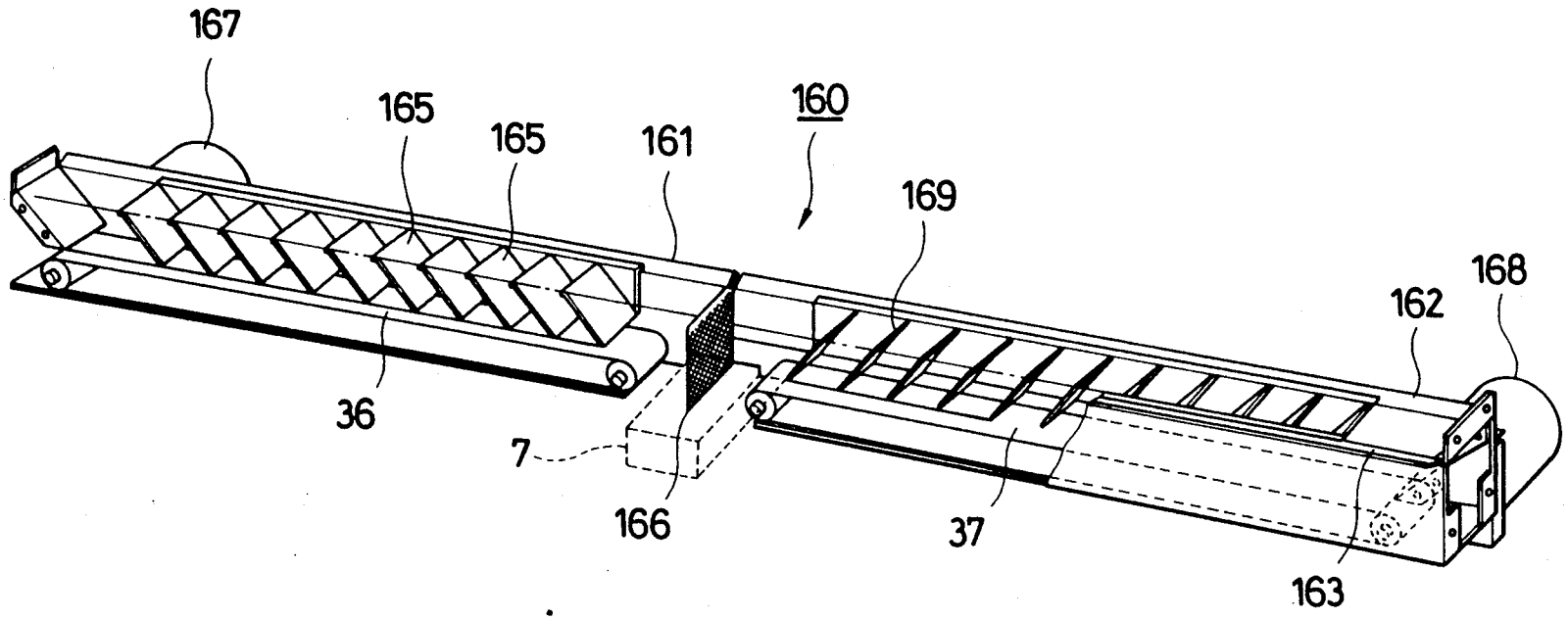
FIG. 18 is a perspective view of a guide means with its side panel partially removed.

Below the hopper 35 is a guide mean 160 as shown in FIG. 18 for guiding the tablets to a transfer mechanism 7. The guide means 160 comprises a multiplicity of inclined plates 165 and 169, a pair of conveyers 36, and 37, and a central upright net 166, all accommodated in a case 161. The guide means 160 receives those tablets falling from the hopper 35, lead them through the inclined plates 165 and 169 to the transfer mechanism 7 at the center of the casing 4 by means of the conveyers 36 and 37 which are driven by means of motors 167 and 168 in the opposite directions, respectively. The net 166 prevents jumping of the tablets from one side to the other side of the guide means as the tablets hit the inclined plates.

The transfer mechanism 7 show in FIGS. 1 and 2 transfers the tablets into a pack which it has formed by sealing a packing sheet 41. Specific features of the transfer mechanism is shown in FIGS. 19 through 26. The transfer mechanism comprises: a reduction gears 250; a driving arm 251 driven by a motor 253; a swing arm 254 driven by a driving arm 251 about a pivotal shaft 252; a fixed base 258 having two guide shafts 255 and a stopper 257 for stopping the bottom plate 38; a movable base 260 driven by the arm 254 over the fixed base 258 and having a base 38, two guide shafts 259, and compression springs 256 wound around the shafts 259; a container guide 261 having a movable container 39 at one end thereof and mounted on the movable base 260 under the biasing force of the compression springs 256 that keeps the guide 261 united with the movable base 260 until the movable base is stopped by a stopper 257; a guide member 264 mounted on the fixed base 258 and having at its front end a packing sheet folding guide 262, a receiver 263 for supporting the packing sheet while printing the prescription data on the packing sheet by means of a printer 45, and at its lower side a pantograph link mechanism serving as a pack opening mechanism 40.

Figure 19:
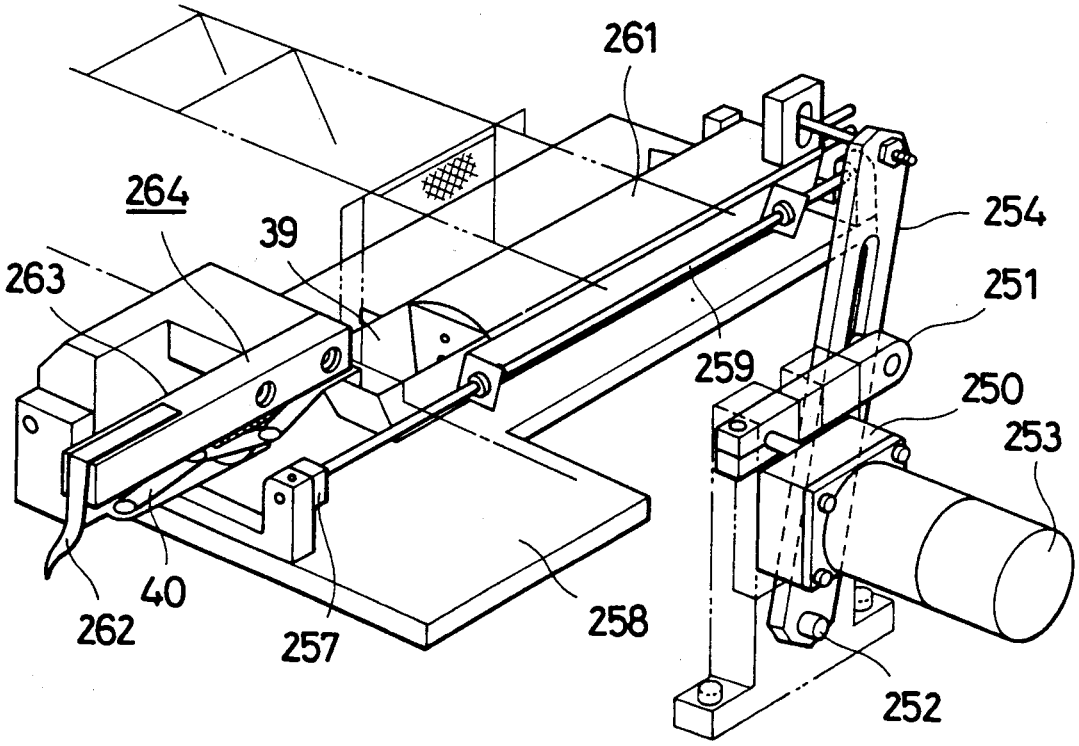
FIGS. 19 through 21 are perspective views illustrating the operation of a transfer mechanism.
Figure 20:
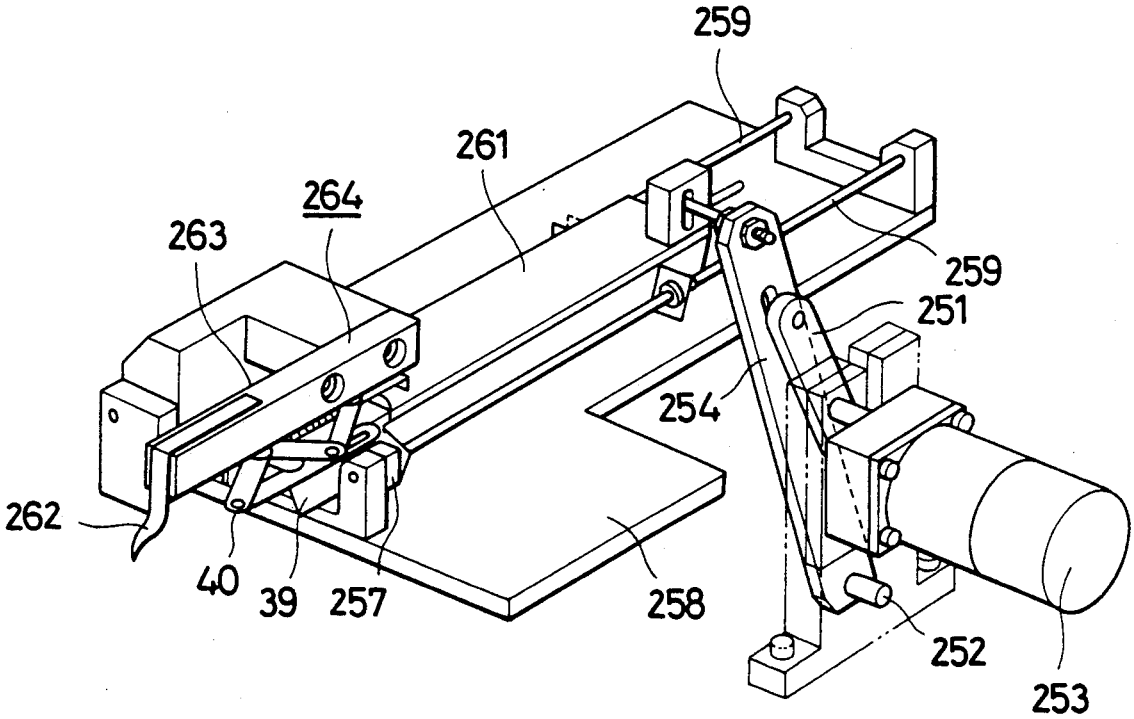
Figure 21:
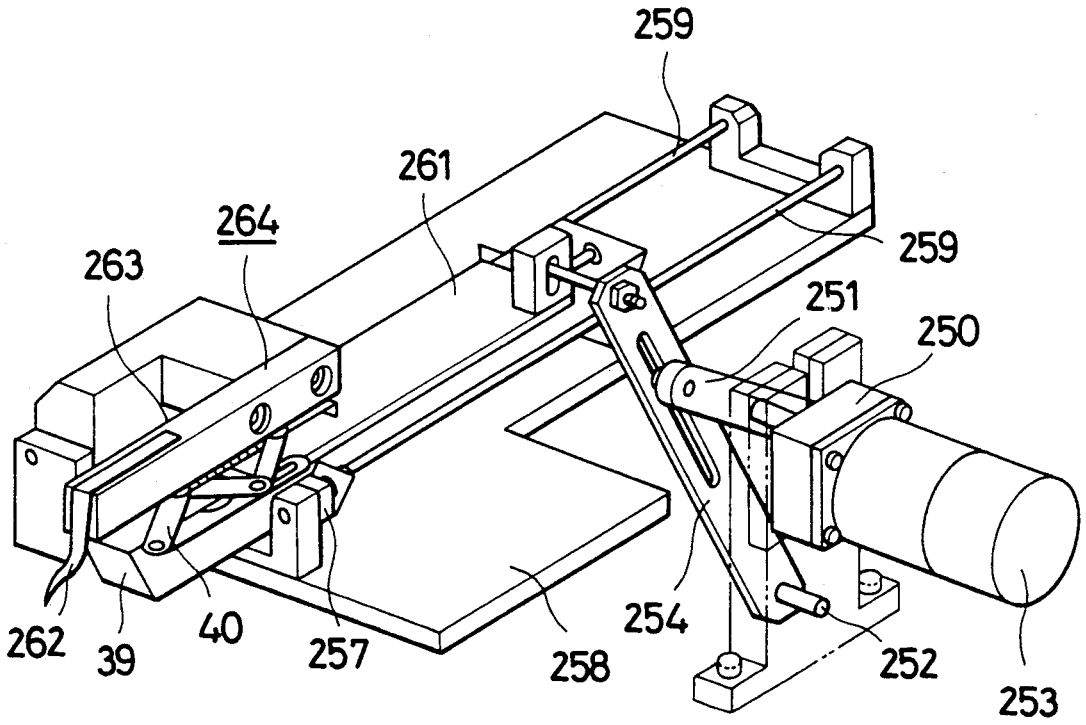
Figure 22:
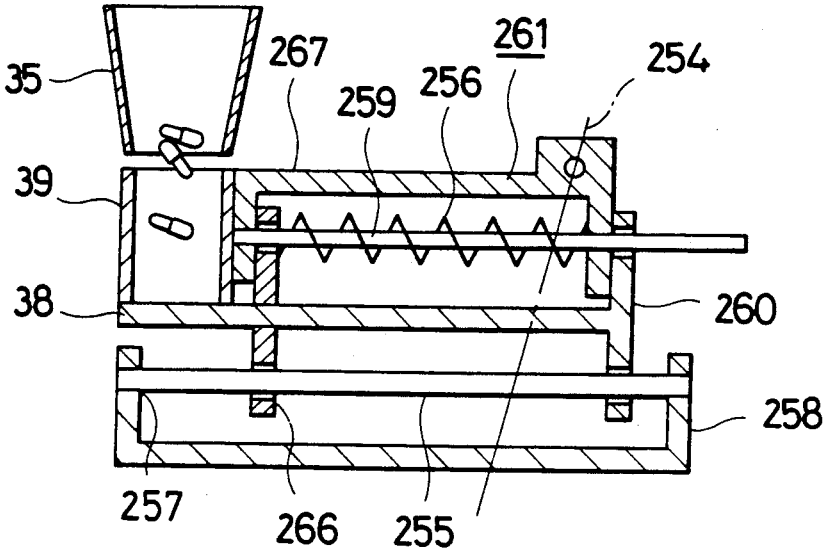
FIGS. 22 through 24 are cross sections of the transfer mechanism.
Figure 23:
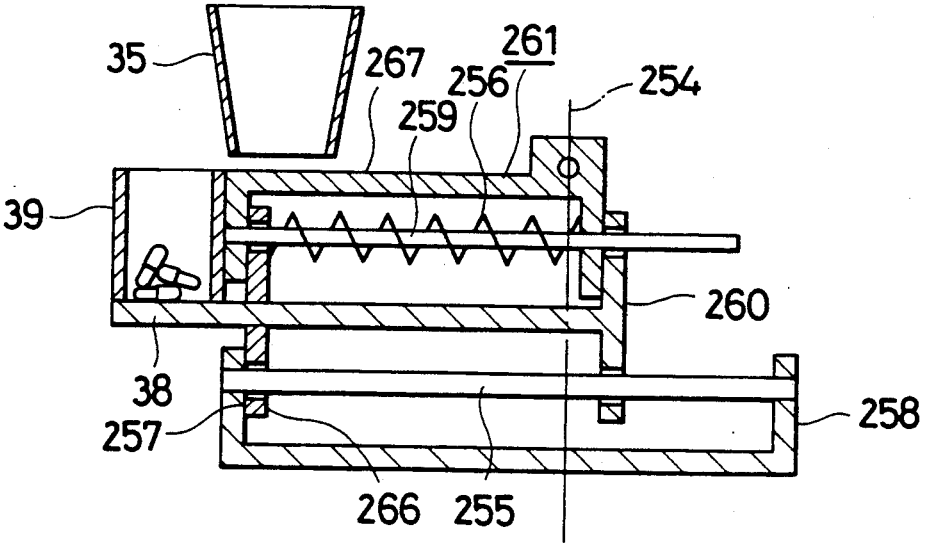

At the time of receiving the tablets, this transfer mechanism 7 assumes an arrangement shown in FIGS. 19 and 22. Namely, the swing arm 254 is inclined backward, holding the movable base 260 and the container guide 261 at their rear positions, where the bottom of the movable container 39 is closed by the bottom plate 38 of the movable base 260 and tablets for one pack may be dropped from the hopper 35 into the movable container 39.

Figure 24:
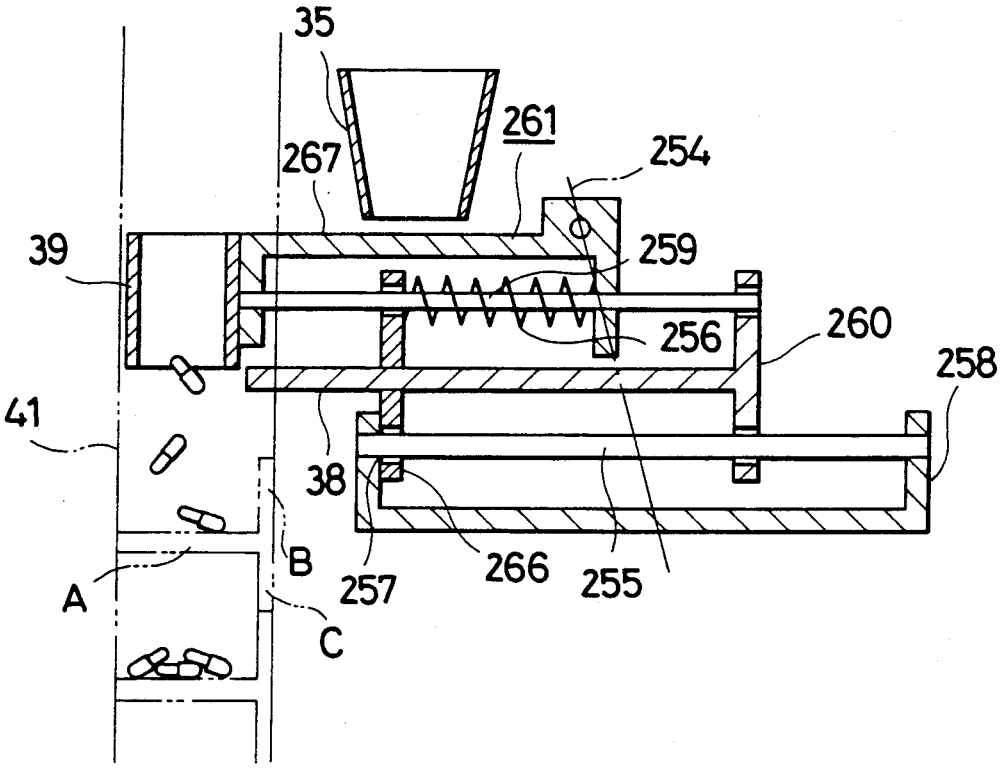

The guide member 264 is furnished with a two-fold packing sheet 41 which is transported downwardly by a roller 46 into the sheet inlet. As the control unit 8 receives from a tablet case 6 a signal indicating that the last tablet is discharged, the motor 253 is driven after a predetermined time (which is the time required for the last tablet to make a trip through the hopper 35, conveyer 36 or 37 and to the movable container 39), after which the container 39 is moved to the position shown in FIGS. 20 and 23. Here, the swing arm 254 is substantially vertical and the movable base 260 has moved forward over the fixed base 258. Since the container guide 261 is moved together with the movable base 260, the bottom of the container is still closed by the bottom plate 38. As the tongue 266 of the movable base 260 abuts on the stopper 257 of the fixed base 258, the movable base 260 is stopped there, and only the container guide 261 keeps on moving over the movable base 260 against the force of the compression springs 256. The container 39 eventually reaches the position as shown in FIG. 24 where it is completely liberated from the bottom plate 38. Now the tablets carried by the movable container 39 are transferred into a sheet of packs 41. The sheet 41 is partially sealed by a T-shaped heat seal mechanism 44 as shown in FIGS. 2 and 24) along a lower end line A, and vertical edges B and C extending upward and downward from A, respectively, to form a pack most of the upper portion of the pack is left open. This pack will be also referred to as a pack, so that the pack may be widely opened and may contain many tablets deeply therein.

Since the upper surface 267 of the container guide 261 is always functioning as a bottom of the hopper 35, so that tablets for the next pack may be kept in the hopper 35, thereby saving time for tablet transfer.

Figure 25:
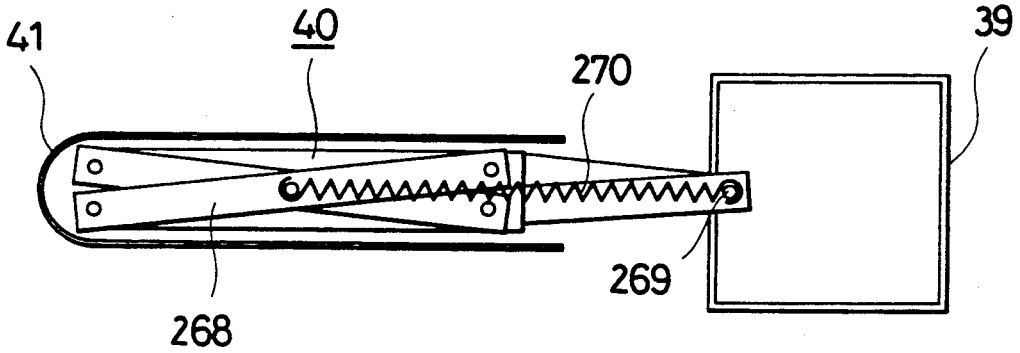
FIGS. 25 and 26 are plan view showing the operation of a pack opening mechanism.
Figure 26:
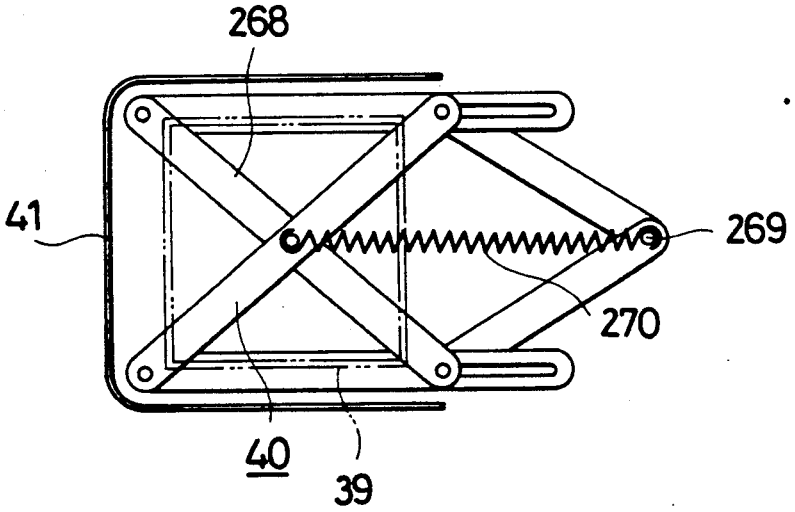
Figure 27:
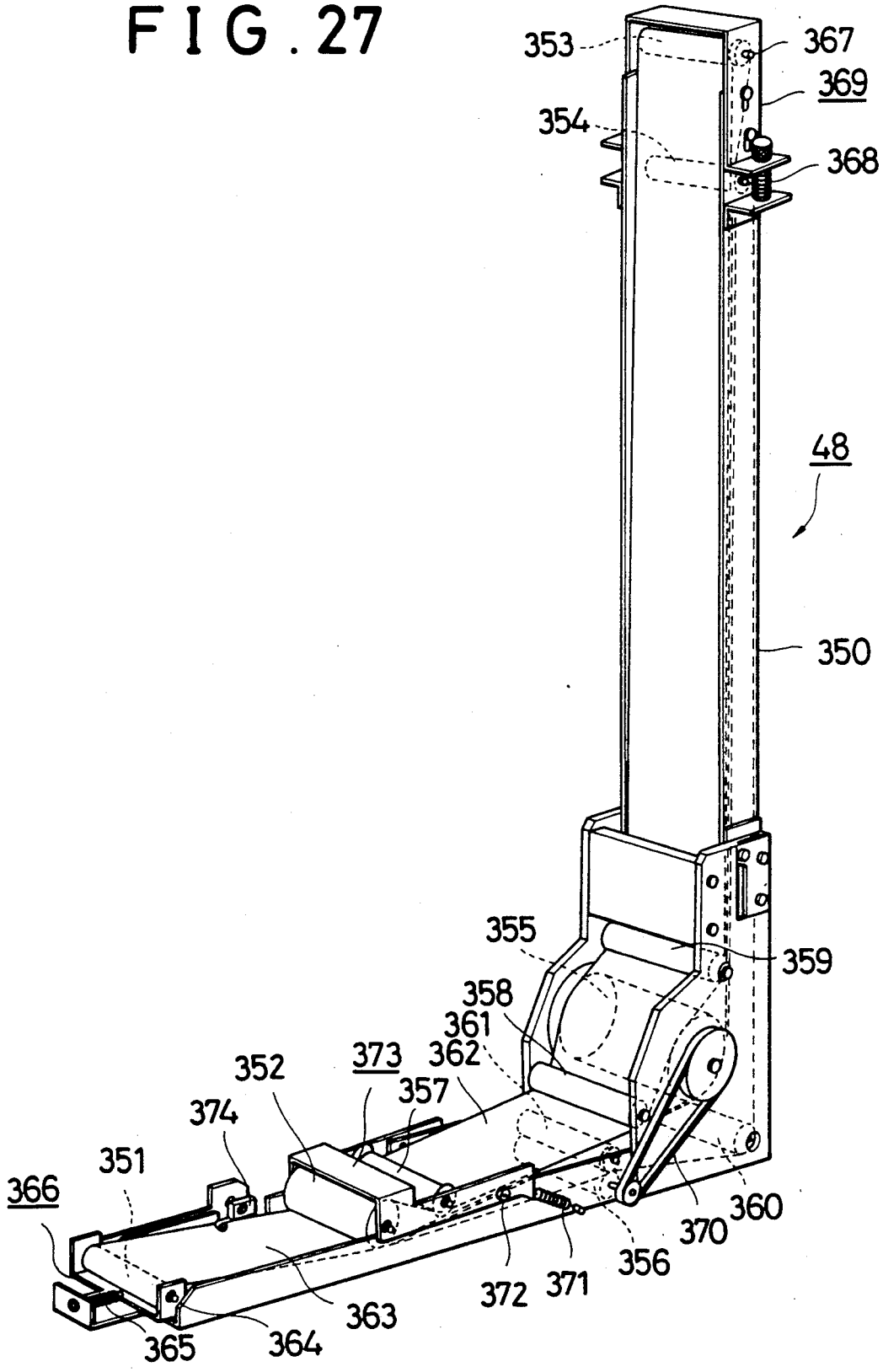
FIG. 27 is a perspective view of a pack transport means.

For this transfer mechanism 7 the swing arm 254 starts its motion with the tablet discharging signal mentioned and undergoes one cycle (going from the position of FIG. 19 through position of FIG. 21 and back to the position of FIG. 19) for every rotation of the motor 253. When the movable base 260 is at the rear position, the pack opening mechanism 40 is flattened, since the supporting beam 269 is engaged with one end of the retracted movable container 39 as shown in FIG. 25. As the movable base 260 moves forward together with the supporting beam 269, the stretched spring 270 gradually contracts as shown in FIG. 26 and the links 268 opens widely the pack sheet 41. This pack opening mechanism 40, linked with the movable container 39, may open the pack without requiring an independent driving mechanism for its own.

Figure 28:
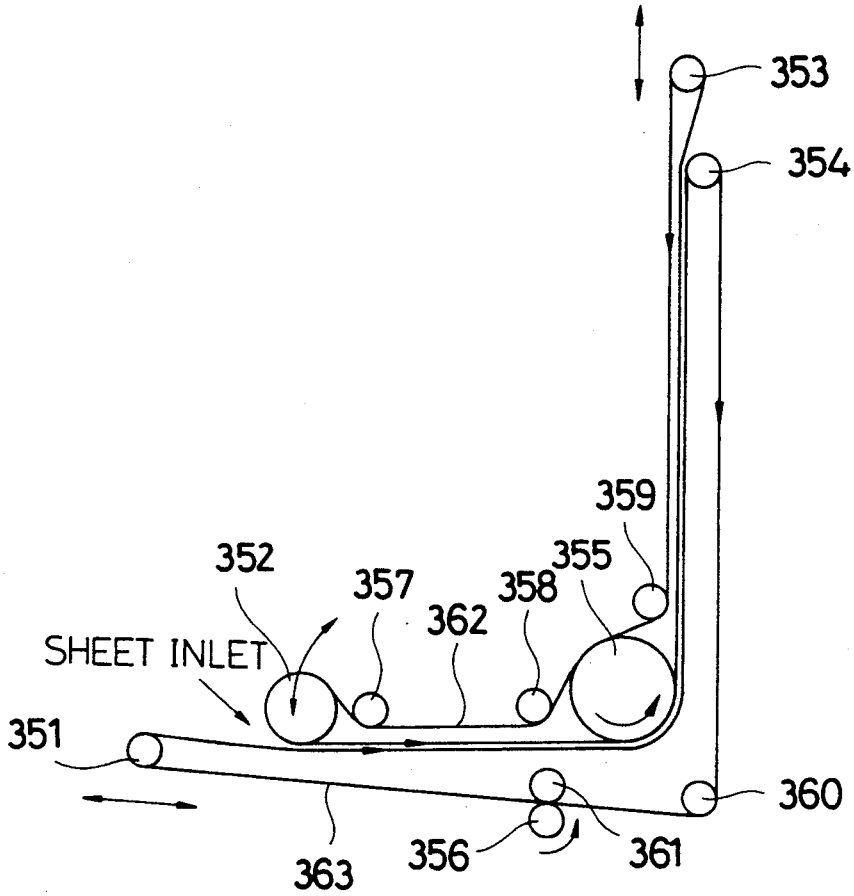
FIG. 28 illustrates the operation of the drug pack transport means shown in FIG. 27.
Figure 29:
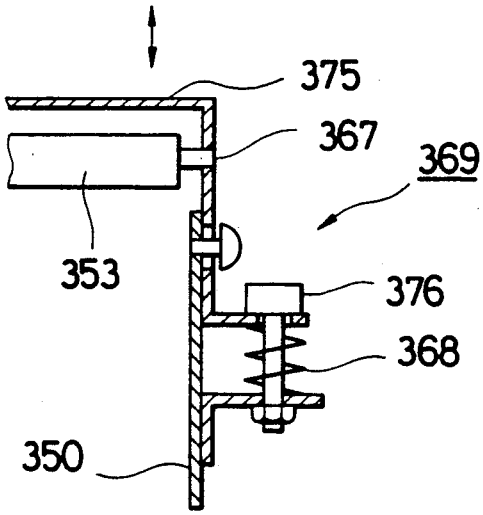
FIG. 29 shows a major portion of the tension means in cross sectional view, for use with the drug pack transport means of this invention.

The drug pack transport means 48 of FIG. 1 comprises: an L-shaped frame 350 disposed at the front corner of the casing 4; a lower roller 351 and upper swing roller 352 disposed at a lower position of the frame 350; an upper roller 353 and lower roller 354 disposed at the upper position of the frame 350; an upper belt drive pulley 355 and lower belt drive pulley 356; an upper tension roller 357, 358, 359 and a lower tension roller 360; a lower pinch roller 361; an upper flat belt 362 trained over the upper swing roller 352, upper belt drive pulley 355, and the upper roller 353; a lower flat belt 363 trained over the lower roller 351, the lower tension roller 360, and the lower roller 354; a lower tension device 366 for giving the lower flat belt 363 necessary tension by pulling the supporting shaft 364 by means of a spring 365; an upper tension device 369 for continually tensioning the upper flat belt 362 by forcing the supporting shaft 367 against the tension by means of a spring 369. The upper belt drive pulley 355 and the lower belt drive pulley 356 are adapted to rotate in the same direction by means of the belt 370, to drive the flat belts 362 and 363 in the direction of an arrow shown in FIG. 28. The upper swing roller 352 and the upper tension roller 357 are mounted on the swing device 373 which is swung up and down about a supporting shaft 372 by a spring 371. At a lower portion of the frame 350 is mounted a limit switch 374 for detecting the tension of the packing sheet carried on the lower flat belt 363, so that in case the packing sheet is too tense the drug pack transport means 48 is stopped. The drug pack transport means 48 is restarted as the drug pack sheet starts sagging. The limit switch 374, provided for controlling the rotational speed of the drug pack transport means, is in OFF state when the packing sheet 41 as the packing sheet 41 is inserted in between the upper and lower flat belts 362 and 363 sags between the feeding roller 46 of the packing machine 3 and the sheet inlet. In this case the drug pack transport means 48 is in operation. When the tension of the packing sheet 41 is sufficient the limit switch is turned ON, state, since the drug packing transport means 48 would be then rotating too fast (in comparison with the feeding rate of the feeding roller 46). As a consequence, the drug pack transport means 48 is stopped. In this manner, synchronism is maintained between the packing machine and the drug pack transport means 48. The upper tension means 366, and lower tension means 369 as well, is structured as shown in FIG. 29, in which the movable frame 375 having the upper roller 353 is mounted, movably in vertical direction, on the top end of the frame 350 with a spring 368 and a bolt 376. The spring 368 always forces the upper flat belt 362 upwardly to maintain necessary tension. The lower tension device 366 is the same in construction as the upper tension device except it uses a spring 365 as a tension spring, so that it is not described here in detail any further.

The tablets are transferred horizontally into a pack and sealed up, forming a series of drug packs 41. The drug pack transport means 48 receives the horizontal series of the drug packs 41 at the sheet inlet where the sheet is pinched in between the upper and lower flat belts 362 and 363 to deliver the sheet vertically to the outlet 47. The outlet faces the upper end of the frame 350. Since the upper and lower flat belts 362 and 363 are free to adjust their length so as to meet the tension requirement by means of the upper and lower tension devices 366 and 369, they can provide proper grip even for heavily packed sheet 41. Furthermore, since the upper and lower flat belts 362 and 363 have the same width as the packing sheet 41, they provide grip sufficient for safe transport of the packing sheet 41 without damaging the tablets. Since the drug pack transport means 48 release the pack sheet from the upper end of the L-shaped frame 350, the transport means 48 permits the drug packing apparatus to discharge the series of drug packs 41 from a high position, which is desirable from a hygienic as well as operability consideration. Since the upper swing roller 352 at the sheet inlet may swing (by means of the swing means 373), the leading tip of the packing sheet may be smoothly inserted into the inlet. Since the drug pack transport means 48 is L-shaped, the drug pack outlet 47 may be faced either to the right side or left side of the drug packing apparatus, depending on the space available in the apparatus. Also, since packed sheets 41 may be delivered substantially vertically from the packing machine, cutting of the packing sheet 41 is easy.

Next, the control operation for the drug packing apparatus is now described.

Figure 30:
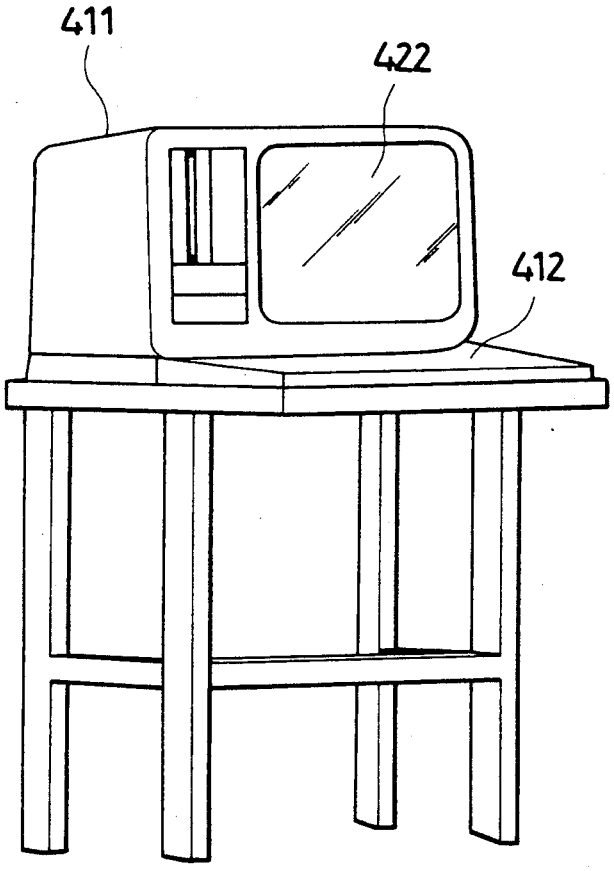
FIG. 30 is a perspective view of a data input unit for inputting data for the drug packing apparatus 1.

FIG. 30 is a perspective view of a prescription data input unit 411 for use with the drug pack packing apparatus 1. The input unit 411, electrically connected with the control unit 8 of the drug packing apparatus, establishes prescription data including the kinds and quantities of the drugs and number of days input from the keyboard 412, and transmits the prescription data to the control unit 8, so that the drug packing apparatus 1 undergoes packing operation to meet the prescription.

Figure 31:
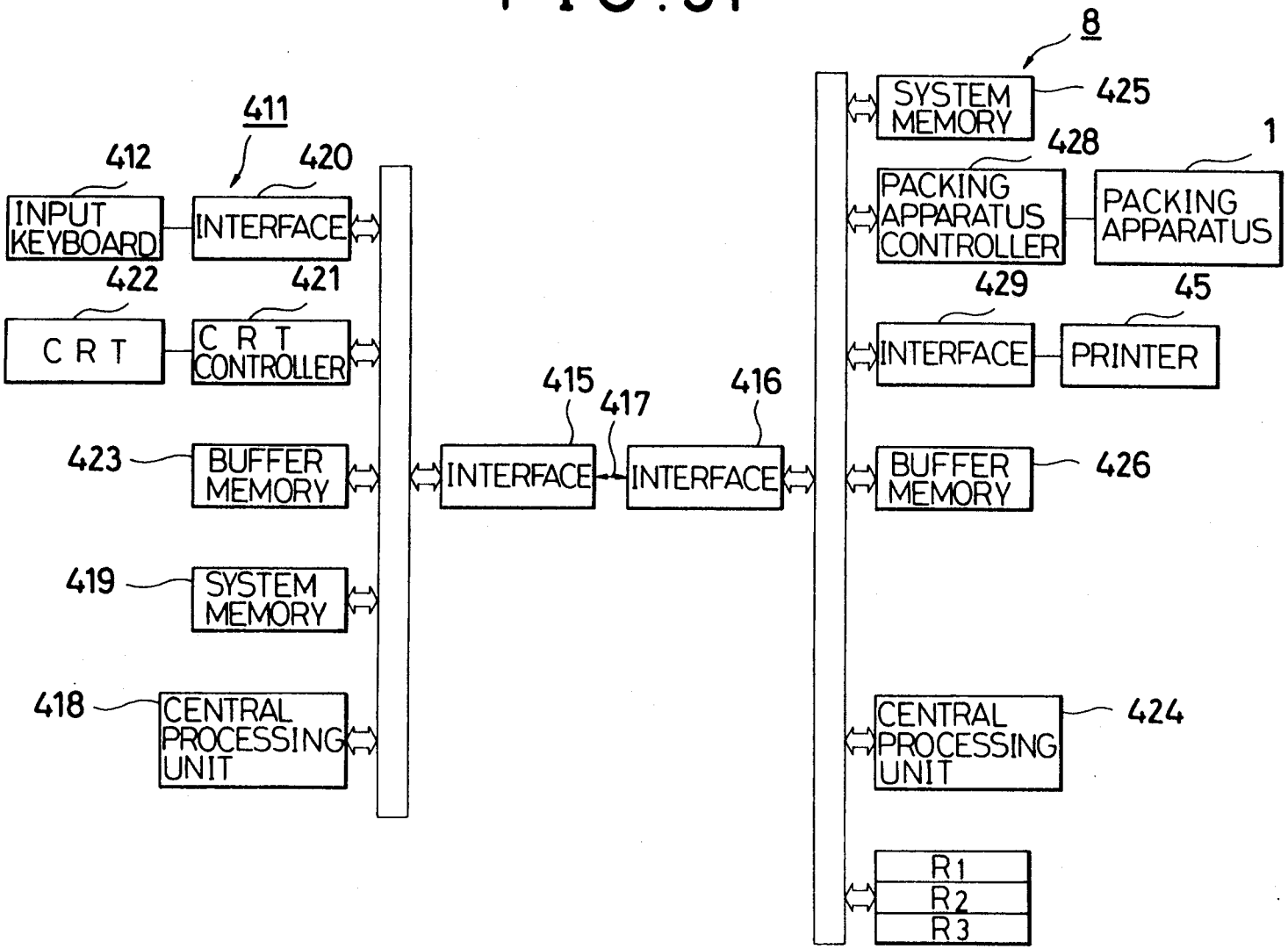
FIG. 31 is a detailed block diagram of control operations in the data input unit and a control unit connected with the drug packing apparatus 1.

FIG. 31 illustrates a detailed structure of the prescription data input unit 411 and the control unit 8, which are shown to be mutually connected through a transmission line 417. The data to be transmitted is transformed into serial data by an interface 415, which data is transformed into parallel data by an interface 416.

The prescription data input unit 411 comprises: a central processing unit 418; a system memory 419 in which control procedure is programmed; a keyboard interface 420 for detecting the operation of the keyboard 412 and generating corresponding key signals; a CRT control unit 421; a CRT display 422 for displaying for a certainly the input prescription such as the kinds and quantities of the drugs and the days; and buffer memory 423 for storing the prescription data.

On the other hand the control unit 8 of the drug packing apparatus comprises: a central processing unit 424; a system program memory 425 which stores programmed procedure to be taken in the drug packing apparatus 1; a buffer memory 426 for storing the prescription data transmitted from the input unit 411; a control unit 428 for controlling the packing operation of the drug packing apparatus 1; a printer interface 429; registers $R_1$, $R_2$, and $R_3$.

In this construction the control unit 8 controls the packing operation based on the prescription data input from the prescription input unit 411, in which the transmission of the prescription data between the prescription data input unit 411 and the control unit 8 is initiated by the transmission of the transfer request signal from the control unit 8 to the prescription data input unit 411.

Figure 32:
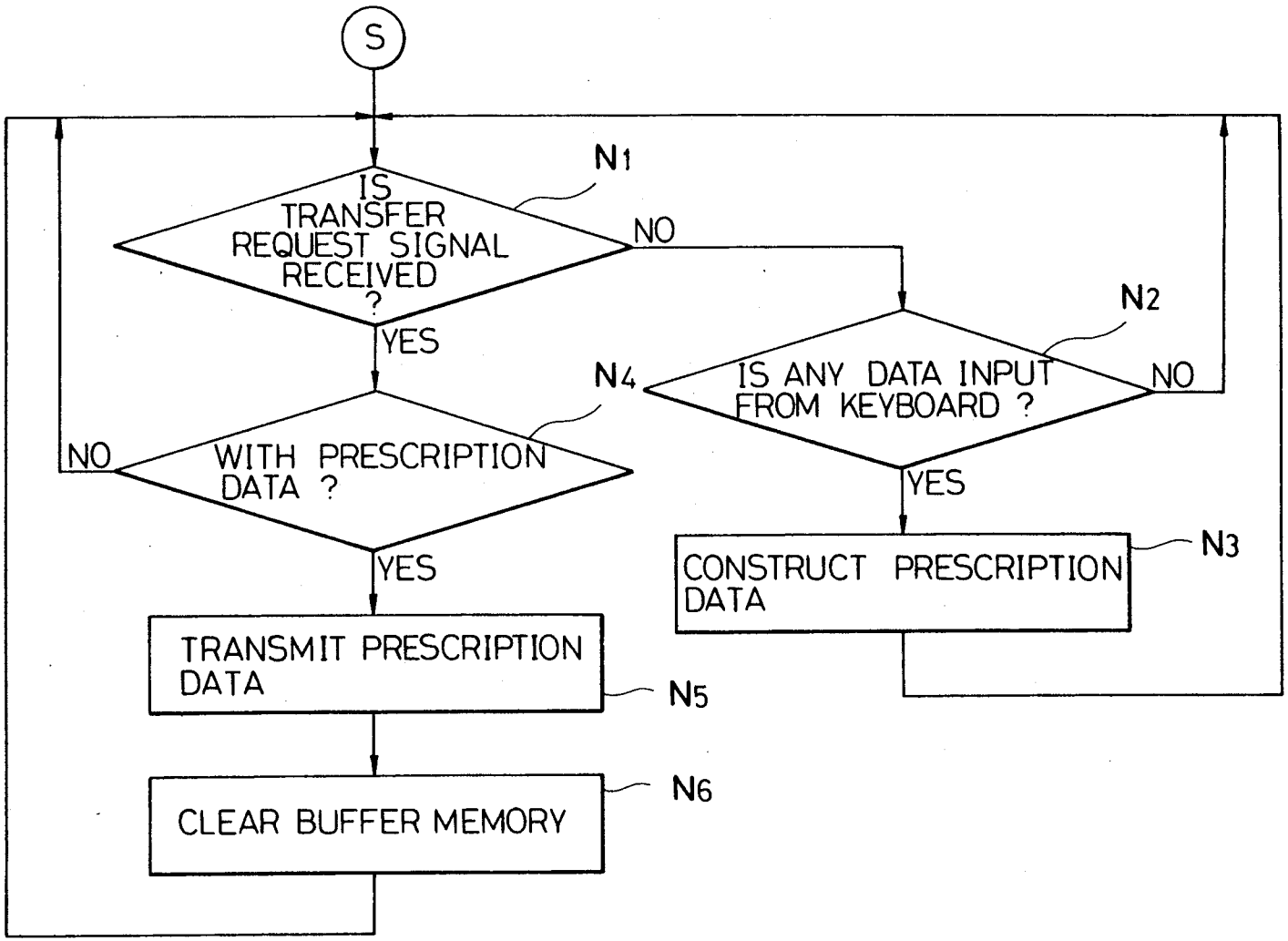
FIG. 32 is a flow chart for the operation of the data input unit.

Referring to the flow chart in FIG. 32, the operation of the prescription data input unit 411 is now described below. The central processing unit 418 makes a decision at step $N_1$ if a transfer request signal is present or not, and, if no transfer request signal is present, makes a decision at step $N_2$ regarding the presence of a keyboard input. If the prescription data such as the kinds and quantities of the drugs and dosage for, e.g. morning, noon, evening, or before going to bed, is input from the keyboard 412, the data is stored in the buffer memory 423 in step $N_3$ in a predetermined format. On the other hand if in step $N_1$ the transfer request signal from the control unit 8 is detected, the procedure proceeds to step $N_4$ and a decision is made if a prescription data is present. If the prescription data has been input from the keyboard, the data is stored in the buffer memory 423, which is then transferred to the control unit 8 of the drug packing apparatus through a transmission line 417 in step $N_5$, In step $N_6$, buffer memory 423 is cleared and the control procedure returns to step $N_1$. If on the other hand no prescription data is found in step $N_4$, the control procedure returns to $N_1$.

Figure 33:
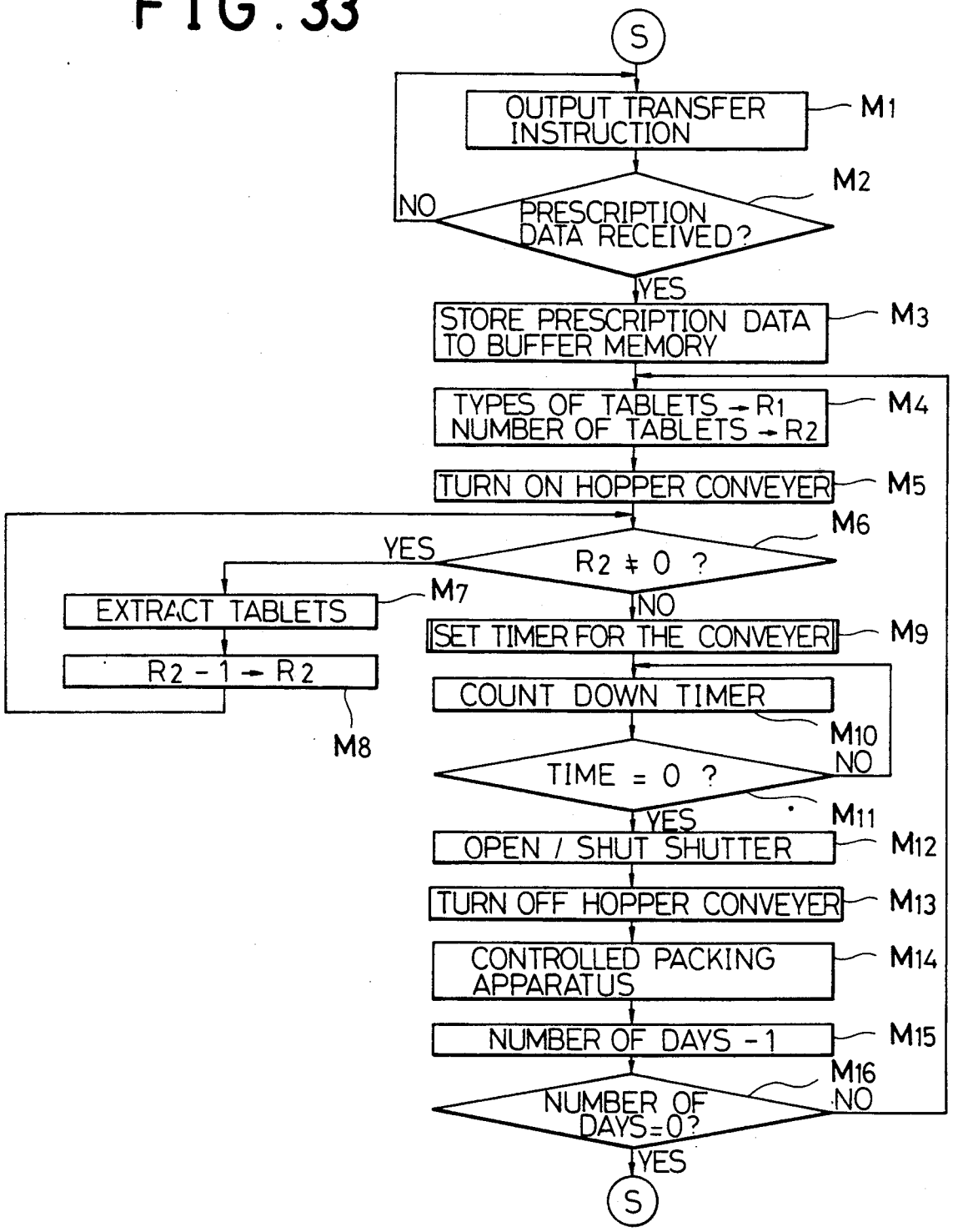
FIG. 33 is a flow chart for the operation of the packing machine.

Referring now to the flowchart shown in FIG. 33 the operation of the control unit 8 is described below. In step $M_1$ a transfer request signal is emitted. In step $M_2$ a decision is made if a prescription data is present. If a prescription data is received from the prescription data input unit 411, the data is stored in the buffer memory 426 in step $M_3$. Next, of the prescription data, the kinds of the drugs are stored in register $R_1$, number of tablets in the register $R_2$ in step $M_4$, and a signal (hereinafter referred to as ON signal) is given in step $M_5$ to the conveyers 36 and 37 of the hopper to collect drugs. In step $M_6$, a decision is made if the content of the register $R_2$ is "0" or not. If the content is not "0", a drug extraction signal is emitted in step $M_7$ to start the extraction of drugs for one pack. In the next step $M_8$, the value stored in the register $R_2$ representative of the number of the tablets to be packed, is decreased by 1, and procedure returns to step $M_6$. This procedure is repeated until the content of the register $R_2$ is nullified, when the procedure transfer to step $M_9$.

Figure 34:
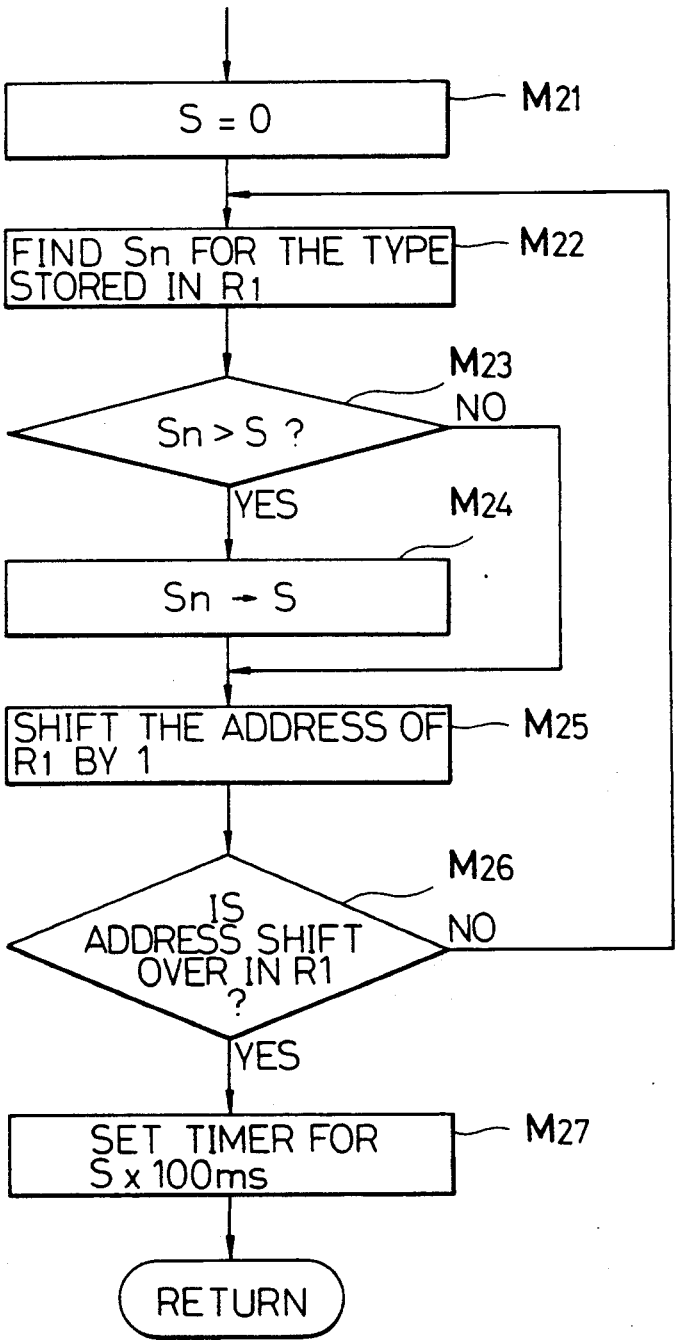
FIG. 34 is a flow chart for setting up conveyer reference time.
Figure 35:
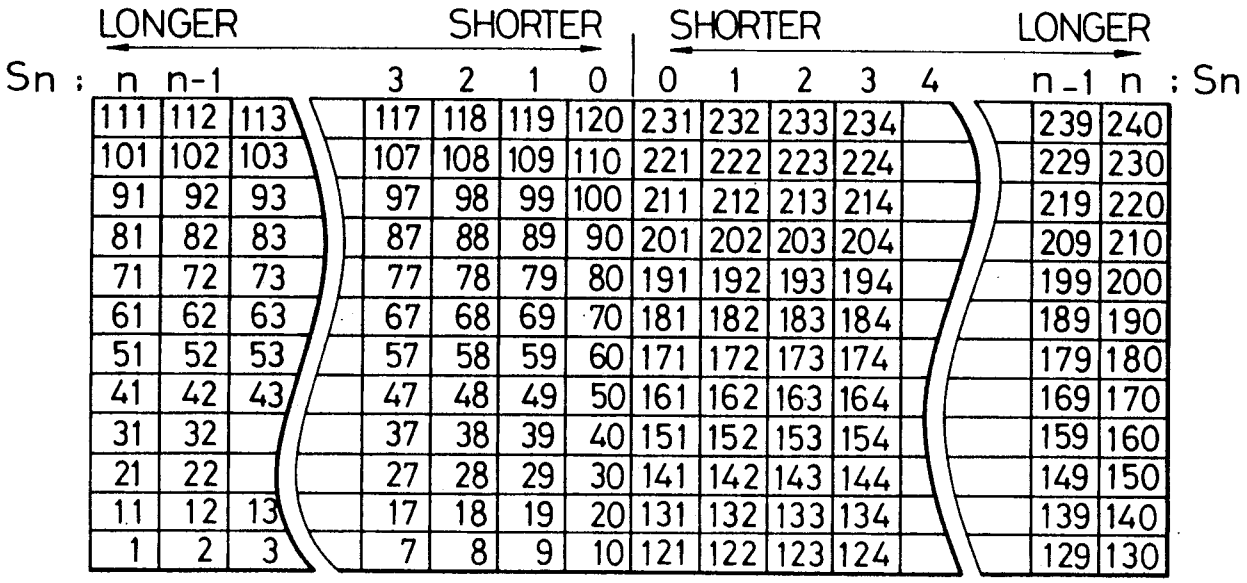
FIG. 35 is a chart showing the relationship between the position of a tablet case and the distance from the position to the movable container.

In step $M_9$, conveyer reference time is defined which is the operation time of the conveyers in unit of 100 ms. The actual operation time of the conveyers is, therefore, obtained by multiplying the conveyer reference time by 100 ms, which is defined as time for the conveyer to stay inactive is set. Referring now to a flowchart in FIG. 34 and FIG. 35, the operation of the conveyers is described. FIG. 35 shows distribution of conveyer reference time Sn ranging from 0 to n in unit of 100 ms for 240 tablet cases, Sn being in correspondence with the distance of a given tablet to the movable container 39, in the order of increasing distance. In this example, n or the maximum value of Sn, is 9.

In step $M_{21}$, the initial value for the conveyer reference time S is set to be 0 in the register $R_3$. In step $M_{22}$ the value Sn (ranging from 0 to 9) is found for the drug stored in the register $R_1$. Recall that $R_1$ stores the kinds of the drugs specified by the prescription at multiple addresses. Namely, in step $M_{22}$, the conveyer reference time is found from FIG. 35 for the drug in the first address of the register $R_1$. Next, in step $M_{23}$ Sn is asked if it is greater than S. In step $M_{24}$, if $Sn > S$, then S is replaced by Sn ($Sn = S$) in register $R_1$. If $Sn \leqq S$, then the procedure transfers to step $M_{25}$, where the address of interrest in the register is shifted by 1. In step $M_{26}$ it is asked if the shift is over for all addresses in the register R1. If it is not, the procedure goes back to step $M_{22}$ to repeat the above steps, while, if it is, then the procedure goes to step $M_{27}$ where conveyer reference time, "$S \times 100$ ms", is set.

In the next step $M_{10}$, conveyer reference time is counted down from the value set in step $M_{27}$. In step $M_{11}$ completion of said counting down is checked. If it is completed, then there follow pack opening with the opening means 40, advancing and retreating of the movable container 39, opening of the lower end of the container, and transferring tablets into a pack. Next, in step $M_{13}$ a signal (referred to as OFF signal) is generated to stop the conveyers 36 and 37.

In step $M_{14}$ packing is performed with the packing machine 3. In steps $M_{15}$ and $M_{16}$ a final packing of the drugs for the entire prescription days is performed.

Although the conveyer reference time has been described above for cases where the kinds of the tablets are specified in a prescription, it should be apparent to those skilled in the art that the time may be established equally well if instead the tablet storing cases are specified in the prescription.

We claim:

1. A drug packing apparatus, comprising:

a drug storing section, said drug storing section including a plurality of drug cases each formed in a shape of vertically elongate tubular member and extending upwardly to within the same height as the entire drug storing section and arranged along a horizontal plane within the drug storing section; and said drug cases each have a drug holding section at the upper part thereof, a mechanical section at the lower part thereof having an opening for drug supply at the top end thereof and a drug outlet at the bottom end thereof to thereby lead drug pieces from said drug cases into said mechanical portion and separate the pieces in said mechanical portion in an ordered arrangement and deliver the pieces one by one from said drug outlet;

a packing machine disposed below said storing section for making packs;

a transfer mechanism for collectively transferring into one pack a predetermined number of drugs discharged from selected drug cases; and a control unit for controlling the discharging of the drugs from said drug cases and the operation of the transfer mechanism.

2. A drug packing apparatus as recited in claim 1, wherein said transfer mechanism is provided with a reciprocally movable container whose bottom may be closed at a first position where the container receives prescribed drugs and opened at a second position where the container collectively release the drugs into a pack.

3. A drug packing apparatus as recited in claim 2 further comprising a pack opening mechanism which widely opens the pack as the container comes to said second position for transferring the drugs.

4. A drug packaging apparatus as in claim 1, and further comprising:

a casing for accommodating in its upper portion said drug storing section and in its lower portion said packing machine:

a hopper having at its bottom a linear outlet and disposed below the drug cases for collecting towards the linear outlet the specified number of drugs discharged from the selected cases;

a guide means having a multiplicity of inclined guide plates, disposed beneath the hopper, for guiding the drugs falling from the hopper to the center of said guide means;

a pair of conveyers for collecting towards the center of the conveyers the drugs falling onto the conveyers, said center being vertically aligned with the center of the hopper;

a transport means for transporting said packed drugs, and said control unit further controlling the transport operation of the drug transport means.

5. A drug packing apparatus as recited in claim 4, wherein only two opposing front and rear panels of said hopper are inclined in a funnel-shape, and at least the front panel is removable from the casing.

6. A drug packing apparatus as in claim 1, and further comprising:

a casing for accommodating in its upper portion said drug storing section and in its lower portion said packing machine;

a pair of conveyers for collecting towards the center of the conveyers the drugs falling onto the conveyers, said center being vertically aligned with the center of the hopper;

a prescription data input unit having a keyboard and a display for inputting prescription data; and said control unit further controlling said collecting of the drugs on the conveyers, operations of said control unit being in response to said input data.

7. A drug packing apparatus as recited in claim 6, wherein said control unit determines the conveyer time of movement based on either the kinds of the drug of the position of the drug case specified by the data input from said prescription data input unit.

8. A drug packing apparatus as recited in claim 7, wherein the conveyer movement time is preset for each drug case in the control unit in accordance with the distance from the drug case to the center of hopper, and in case several drugs are specified in the prescription date, the longest reference time associated with the farthest drug case is chosen as the conveyer reference time, and operation time of the conveyer is determined based on said longest reference time.

9. A drug packing apparatus, comprising:

a drug storing section including a plurality of elongate drug cases which extend upwardly and are in planar arrangement to one another, a packing machine disposed below said storing section for making packs;

drug pack transport means for delivering the packs to the outlet of the apparatus, which transport means comprises:

an L-shaped frame having an outlet;

at least two pairs of rollers mounted on the opposite ends of the frame;

a driving pulley mounted at one corner of the frame;

two flat belts each trained over an associated pair of said rollers, forming double layered conveyers extending between the upper and lower end of the frame; and a tension means for displacing the shafts of the rollers in the directions away from the belt, wherein said drug pack transport means is adapted to pinch at the lower end of the frame a series of said packs between the flat belt, and to convey the packs to the frame outlet.

10. A drug packing apparatus, comprising:

a drug storing section including a plurality of elongate drug cases which extend upwardly and are in planar arrangement to one another;

said drug cases each have a form of an elongated tubular member whose upper portion forms a drug holding section and lower portion forms a mechanical section, said mechanical section comprising:

a cylinder having a hole through its longitudinal central axis and bisected into two semi-cylinders;

a driving shaft for supporting and alternately driving the semi-cylinders up and down;

a multiplicity of pawls which comes in and out of said cylinder in association with the upward and downward motion of the semi-cylinders, to thereby line-up and separate the drugs in the drug holding section, and discharge them from the lower end of the mechanical section one by one by the action of the pawls;

a packing machine disposed below said storing section for making packs;

a transfer mechanism for collectively transferring into one pack a predetermined number of drugs discharged from selected drug cases; and a control unit for controlling the discharging of the drugs from said drug cases and the operation of the transfer mechanism.

11. A drug packing apparatus as recited in claim 10, wherein said drug cases are each provided over the upper opening thereof with a freely movable lid whose back side serves as a guiding surface for the drug to be replenished.

* * * * *